US009328582B2

(12) United States Patent
Trevino

(10) Patent No.: US 9,328,582 B2
(45) Date of Patent: May 3, 2016

(54) LATCH ASSEMBLY

(71) Applicant: Weatherford Technology Holdings, LLC, Houston, TX (US)

(72) Inventor: Jose A. Trevino, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 371 days.

(21) Appl. No.: 13/774,951

(22) Filed: Feb. 22, 2013

(65) Prior Publication Data

US 2013/0233534 A1 Sep. 12, 2013

Related U.S. Application Data

(60) Provisional application No. 61/601,676, filed on Feb. 22, 2012.

(51) Int. Cl.

| | |
|---|---|
| ***E21B 33/14*** | (2006.01) |
| ***E21B 7/20*** | (2006.01) |
| ***E21B 17/04*** | (2006.01) |
| ***E21B 33/04*** | (2006.01) |
| ***E21B 4/00*** | (2006.01) |
| ***E21B 17/046*** | (2006.01) |

(52) U.S. Cl.

CPC ..... *E21B 33/0422* (2013.01); *E21B 4/00* (2013.01); *E21B 7/20* (2013.01); *E21B 7/208* (2013.01); *E21B 17/046* (2013.01); *E21B 33/14* (2013.01)

(58) Field of Classification Search

CPC .... E21B 33/0422; E21B 17/046; E21B 23/02

See application file for complete search history.

(56) References Cited

U.S. PATENT DOCUMENTS

| | | | | | |
|---|---|---|---|---|---|
| 2,775,472 | A | * | 12/1956 | Brown | 285/343 |
| 3,087,547 | A | * | 4/1963 | Raulins et al. | 166/89.1 |
| 3,297,344 | A | * | 1/1967 | Hanes | 285/123.9 |
| 3,321,217 | A | * | 5/1967 | Ahlstone | 285/18 |
| 3,661,206 | A | * | 5/1972 | Putch et al. | 166/89.2 |
| 4,222,592 | A | * | 9/1980 | Saliger et al. | 285/18 |
| 4,295,796 | A | * | 10/1981 | Moore | 417/115 |
| 4,335,904 | A | * | 6/1982 | Saliger et al. | 285/18 |
| 4,491,345 | A | * | 1/1985 | Regan | 285/18 |
| 4,552,213 | A | * | 11/1985 | Boyd et al. | 166/88.4 |
| 5,092,402 | A | * | 3/1992 | Perricone et al. | 166/113 |

(Continued)

FOREIGN PATENT DOCUMENTS

| | | | |
|---|---|---|---|
| WO | 02055838 | | 7/2002 |
| WO | 2004079151 | A2 | 9/2004 |
| WO | WO 2013126827 | A2 * | 8/2013 |

OTHER PUBLICATIONS

PCT International Search Report and Written Opinion for Application PCT/US2013/027495, dated Jul. 4, 2014.

(Continued)

*Primary Examiner* — Jennifer H Gay

(74) *Attorney, Agent, or Firm* — Patterson & Sheridan, LLP

(57) ABSTRACT

A releasable latch system used to releasably couple a surface casing to a conductor casing. A latch assembly for coupling a first tubular to a second tubular includes a mandrel having a plurality of key slots; a housing for receiving the mandrel; a plurality of keys radially movable into engagement or out of engagement with a respective key slot; a collet configured to engage the housing and a respective key; and a retainer ring configured to hold the plurality of keys in engagement with the respective key slot.

27 Claims, 47 Drawing Sheets

(56) References Cited

U.S. PATENT DOCUMENTS

| | | | | |
|---|---|---|---|---|
| 5,163,514 | A * | 11/1992 | Jennings | 166/368 |
| 5,333,911 | A * | 8/1994 | Watkins | 285/18 |
| 5,582,438 | A * | 12/1996 | Wilkins et al. | 285/26 |
| 5,829,480 | A * | 11/1998 | Smith, III | 137/614.04 |
| 6,328,343 | B1 * | 12/2001 | Hosie et al. | 285/90 |
| 6,385,891 | B1 * | 5/2002 | Rabatin | 42/79 |
| 6,474,412 | B2 * | 11/2002 | Hamilton et al. | 166/77.51 |
| 6,823,938 | B1 * | 11/2004 | Milberger | 166/209 |
| 7,441,594 | B2 * | 10/2008 | Vanderford et al. | 166/75.14 |
| 7,798,208 | B2 * | 9/2010 | Purkis | 166/75.14 |
| 7,819,182 | B2 * | 10/2010 | Adamek | 166/66 |
| 8,388,255 | B2 * | 3/2013 | Larson et al. | 403/316 |
| 8,505,652 | B2 * | 8/2013 | Williams et al. | 175/195 |
| 9,057,239 | B2 * | 6/2015 | Young | |
| 2001/0009189 | A1 * | 7/2001 | Brooks et al. | 166/50 |
| 2003/0192704 | A1 | 10/2003 | Ford et al. | |
| 2004/0245020 | A1 | 12/2004 | Giroux et al. | |
| 2008/0245534 | A1 * | 10/2008 | Purkis | 166/379 |
| 2008/0314577 | A1 * | 12/2008 | Adamek | 166/66 |
| 2010/0243238 | A1 * | 9/2010 | Gette et al. | 166/208 |
| 2013/0233534 | A1 * | 9/2013 | Trevino | 166/75.14 |
| 2014/0203547 | A1 * | 7/2014 | Krueger et al. | 285/145.1 |

OTHER PUBLICATIONS

PCT Search Report and Written Opinion for International Application No. PCT/US2013/027490 dated Sep. 17, 2014.

* cited by examiner

LATCH ASSEMBLY

BACKGROUND OF THE INVENTION

1. Field of the Invention

Embodiments of the present invention generally relate to methods and apparatus for drilling with casing. More particularly, the present invention relates to methods and apparatus for coupling two strings of casings.

2. Description of the Related Art

In the oil and gas producing industry, the process of cementing casing into the wellbore of an oil or gas well generally comprises several steps. For example, a conductor pipe is positioned in the hole or wellbore and may be supported by the formation and/or cemented. Next, a section of a hole or wellbore is drilled with a drill bit which is slightly larger than the outside diameter of the casing which will be run into the well.

Thereafter, a string of casing is run into the wellbore to the required depth where the casing lands in and is supported by a well head in the conductor. Next, cement slurry is pumped into the casing to fill the annulus between the casing and the wellbore. The cement serves to secure the casing in position and prevent migration of fluids between formations through which the casing has passed. Once the cement hardens, a smaller drill bit is used to drill through the cement in the shoe joint and further into the formation.

Typically, when the casing string is suspended in a subsea wellhead or casing hanger, the length of the casing string is shorter than the drilled open hole section, allowing the casing hanger or high pressure wellhead housing to land into the wellhead prior to reaching the bottom of the open hole. Should the casing reach the bottom of the hole prior to landing the casing hanger or high pressure wellhead housing, the system would fail to seal and the casing would have to be retrieved or remedial action taken.

The difficulty in positioning the casing at the proper depth is magnified in operations where casing is used as the drill string. In general, drilling with casing allows the drilling and positioning of a casing string in a wellbore in a single trip. However, drilling with casing techniques may be unsuitable in the instance where the casing string must land in a wellhead. To reach proper depth to land a casing hanger or high pressure wellhead housing in the wellhead, the casing string must continue to drill to the proper depth. However, continued rotation while the casing hanger or high pressure wellhead housing is near, or in, the wellhead may damage the wellhead and/or it's sealing surfaces. Thus, the casing string may be prematurely stopped to avoid damaging the wellhead.

There is a need, therefore, for improved methods and apparatus for coupling two strings of casing. There is also a need for apparatus and methods for drilling with a casing and landing the casing in a wellhead.

SUMMARY OF THE INVENTION

In one embodiment, a latch assembly for coupling a first tubular to a second tubular includes a mandrel having a plurality of key slots; a housing for receiving the mandrel; a plurality of keys radially movable into engagement or out of engagement with a respective key slot; a collet configured to engage the housing and a respective key; and a retainer ring configured to hold the plurality of keys in engagement with the respective key slot.

In another embodiment, a latch assembly for coupling a first tubular to a second tubular includes a mandrel having a plurality of key slots; a housing for receiving the mandrel; a plurality of keys radially movable into engagement or out of engagement with a respective key slot; a retainer ring selectively rotatable relative to the housing; a setting member for rotating the retainer; and a plurality of openings circumferentially spaced on the housing for receiving the setting member.

In another embodiment, a latch assembly for coupling a first tubular to a second tubular includes a mandrel; a housing for receiving the mandrel, the housing including a plurality of segments having keys; and a load block releasably coupled to the mandrel, the load block having slots for mating with the keys.

In another embodiment, a latch assembly for coupling a first tubular to a second tubular includes a mandrel having a plurality of key slots; a housing for receiving the mandrel; a plurality of keys radially movable into engagement or out of engagement with a respective key slot; and a rotatable sleeve for radially moving a respective key and coupled to the key using a shearable thread connection.

In another embodiment, a latch assembly for coupling a first tubular to a second tubular includes a mandrel coupled to a first tubular and having a longitudinal groove and an arcuate groove; and a housing coupled to the second tubular and adapted to receive the mandrel, wherein the housing includes a first pin for coupling with the longitudinal groove and a second pin for coupling with the arcuate groove.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention provides a releasable latch mechanism for coupling a first tubular to a second tubular. For example, the latch mechanism may be used to couple a first casing to a second casing positioned inside the first casing. The latch mechanism may be released to allow the second casing to move relative to the first casing.

In one embodiment, a releasable connection is used to couple a conductor casing to a surface casing during jetting operations. Thereafter, the releasable connection is activated to release the surface casing after the jetting process is complete. The releasable connection is adapted to minimize the potential for inadvertently release or re-lock. Also, the releasable connection may optionally be configured to release upon the occurrence of two or more events, for example, axial then rotation. In another embodiment, the releasable connection is configured for axial adjustment to allow proper bit "stick-out or stick-in" relative to the conductor casing for jetting operations. In yet another embodiment, the releasable connection is configured for installation even under sea conditions including and not limited to heave, sea current, and tide. In yet another embodiment, the releasable connection is configured to carry axial loads from at least the weight of the conductor, weight of the low pressure wellhead, and jetting friction. In yet another embodiment, the releasable connection may include a latch mechanism that allows the bottom hole assembly and surface casing to pass through, in the event there is a need to retrieve the BHA after the conductor has been jetted. In yet another embodiment, the latch is compatible with inclination measuring equipment. In yet another embodiment, the releasable connection allows for simple rig up.

Figures 1A, 1B:
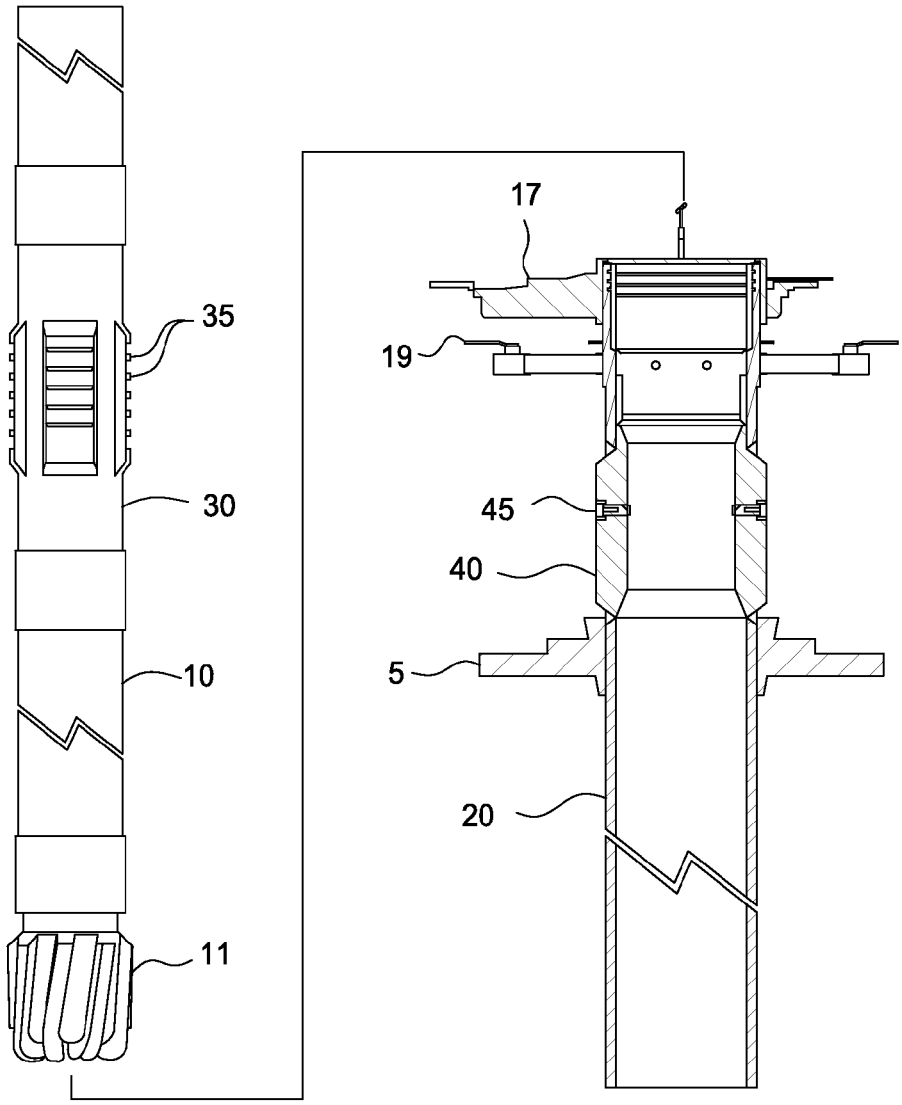
FIGS. 1A-B illustrate an embodiment of a latch system for coupling two casings.
Figure 2:
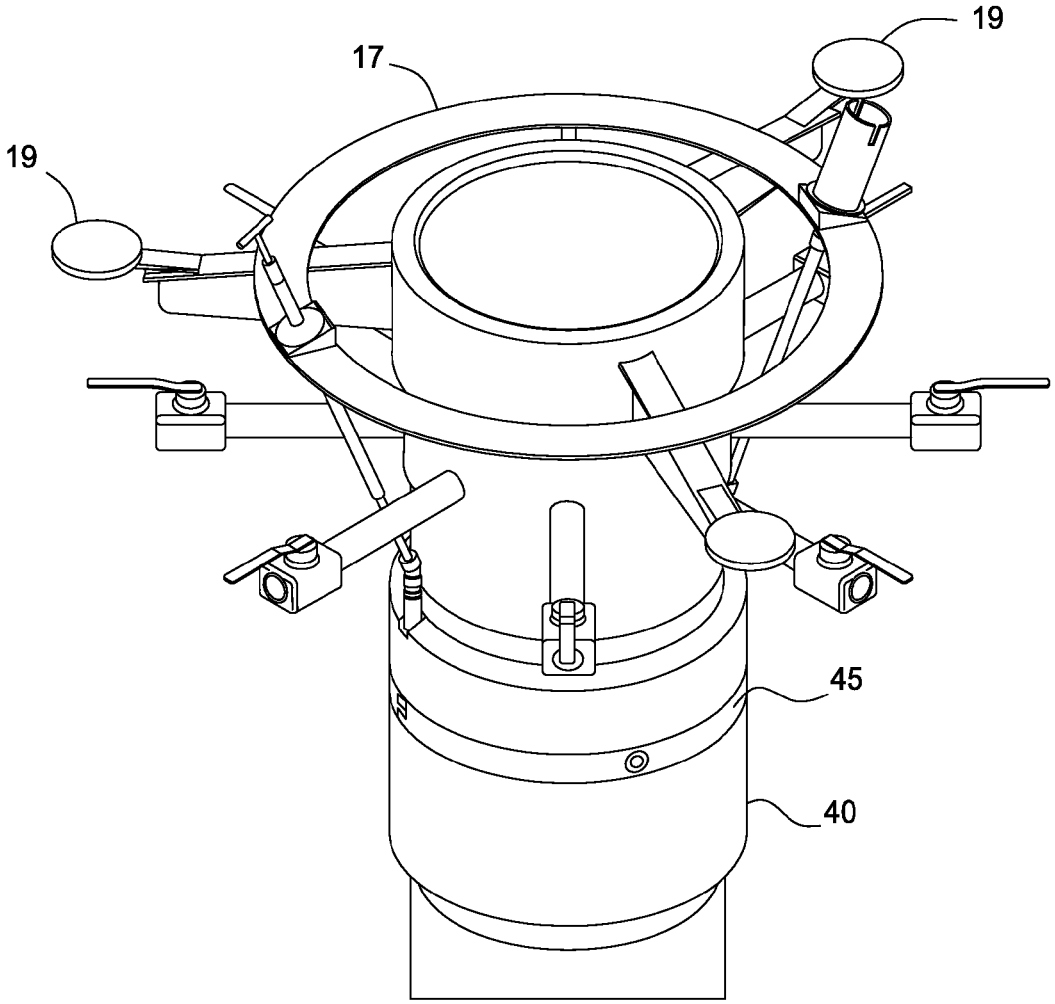
FIGS. 2-6 illustrate an embodiment of a latch mechanism.

FIGS. 1A-B illustrate an embodiment of a latch system for coupling a first casing 10 (such as a 22" casing) to a second casing 20 (such as a 36" casing). FIG. 1A shows the first casing 10 provided with a drilling member 11 at a lower end and a latch mandrel 30 connected between the casing sections. The latch mandrel 30 includes key slots 35 disposed on the exterior of the latch mandrel 30. The key slots 35 may be provided as a continuous circumferential slot or discreet slot segments. As shown in FIG. 1A, the key slots 35 are provided as four circumferentially spaced segments. In addition to being circumferentially positioned, a plurality of key slots 35 may be axially spaced along the latch mandrel 30. The axial spacing of the key slots 35 allows relative axial positioning of the first casing 10 relative to the second casing 20.

FIG. 1B shows the second casing 20 being held by the slips of a surface table 5 which may be located on the rig floor or the rotary table. The second casing 20 includes a low pressure wellhead 21, latch housing 40, and a string of casing. The latch housing 40 includes one or more load keys 45 for engaging the key slots 35 of the latch mandrel 30. In this embodiment, two load keys 45 are positioned 180 degrees apart, although any suitable number of load keys may be used. The load keys 45 are radially movable to engage or disengage from the key slots 35.

Latch Concept 1

Figure 3:
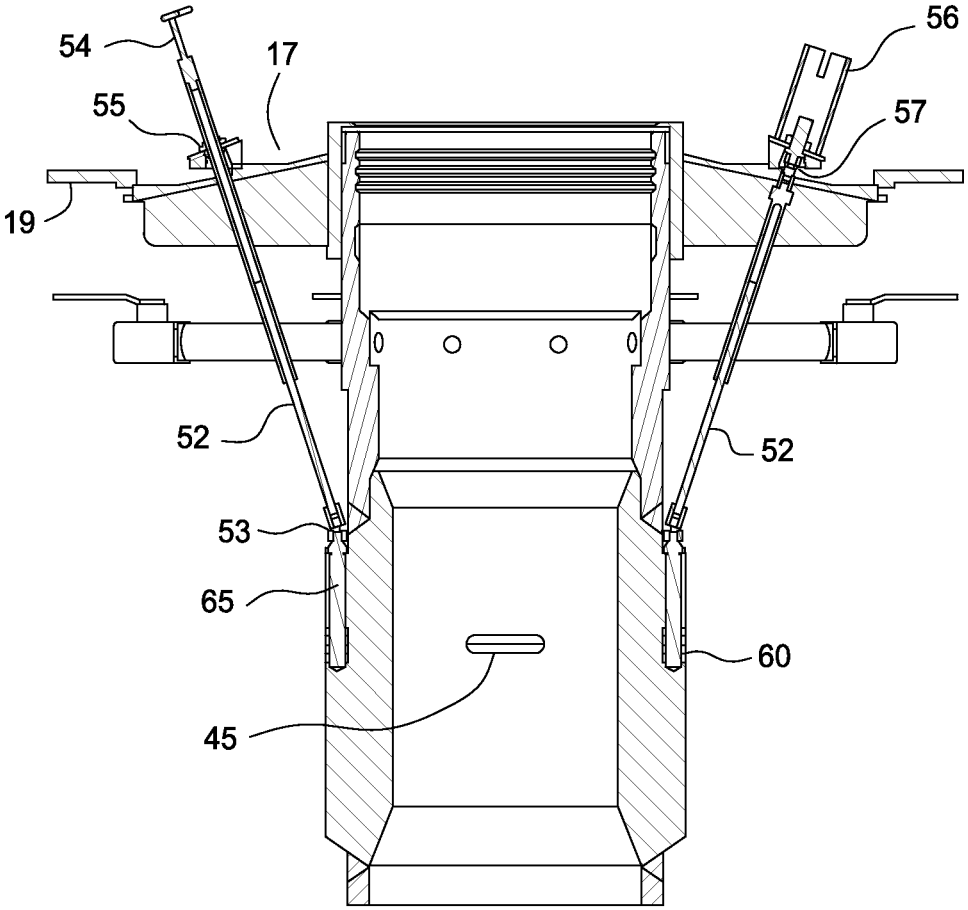
Figure 4:
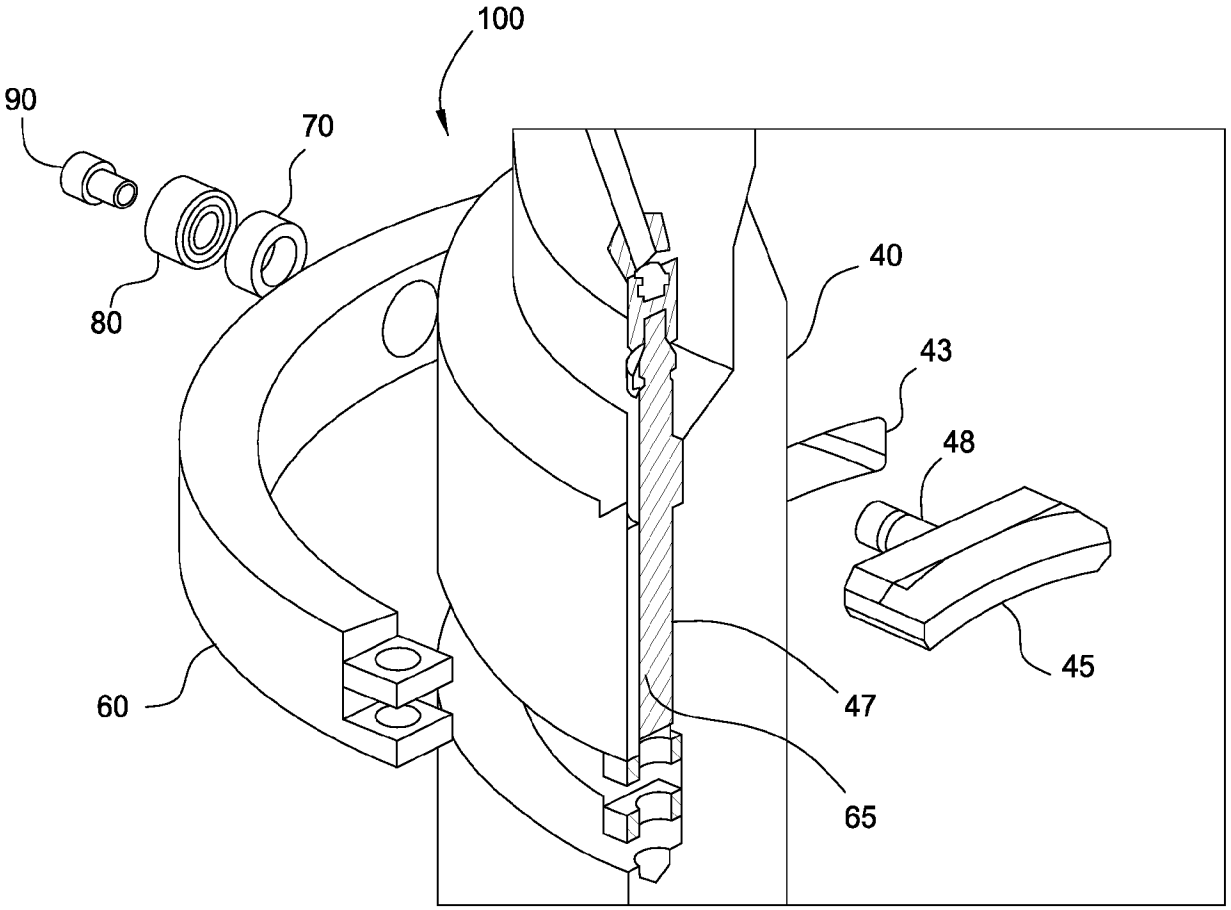

FIGS. 2-6 illustrate an embodiment of a latch mechanism 100 for engaging and disengaging the load keys 45 from the key slots 35. Referring to FIGS. 3 and 4, the latch mechanism 100 includes a retainer 60 for retaining the load key 45. The retainer 60 is ring shaped and is formed by joining at least two arcuate segments. The arcuate segments may be joined by inserting a retainer pin 65 through the hinges of two adjacent segments. In one embodiment, the retainer pin 65 may be threadedly coupled to a slot 47 in the housing 40. A telescopic member 52 is coupled to the upper end of the retainer pin 65 using a universal joint 53. The other end of the telescopic member 52 includes a handle 54 that can be rotated by a remotely operated vehicle ("ROV") to release the retainer pin 65 from the hinges of the retainer segments. A ball joint 55 may be used to couple the telescopic member 52 to the vertical positioning equipment 17 (optionally equipped with a "bullseye" 19) to facilitate rotation of the telescopic member 52. In another embodiment, the upper end of the telescopic member 52 is coupled to a torque tool receiver 56 using another universal joint 57. A ROV may operate a torque tool to engage the torque tool receiver 56 in order to rotate the retainer pin 65.

Figures 5, 6:
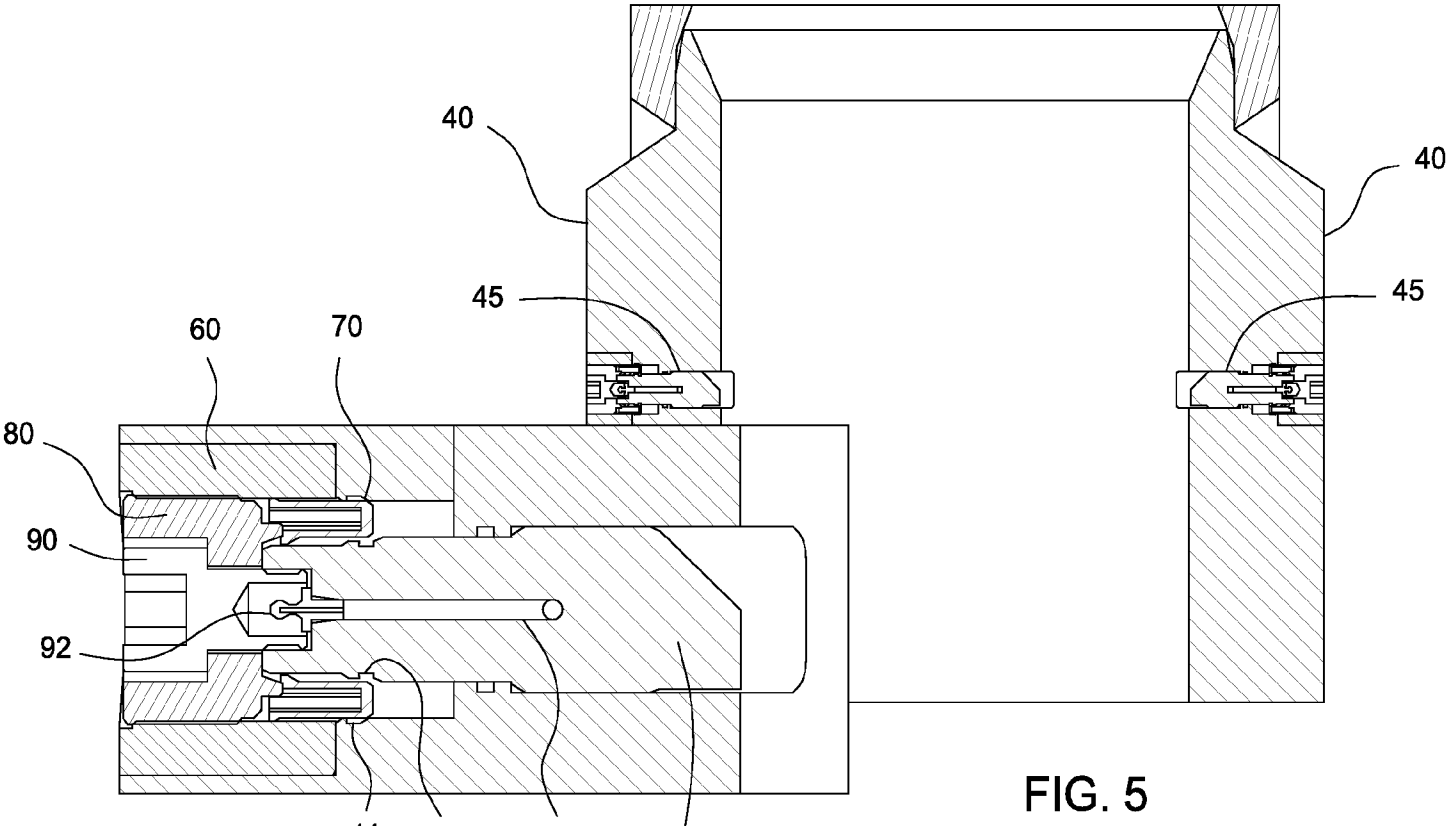

The load keys 45 are coupled to the housing 40 using the retainer 60, a collet 70, a jam nut 80, and a holding bolt 90. As shown in FIG. 4, the load key 45 includes a connector shaft 48 that is inserted through an opening 43 in the housing 40 from the interior side of the housing 40. The connector shaft 48 is coupled to the retainer 60, the collet 70, the jam nut 80, and the holding bolt 90 at the exterior side of the housing 40. FIG. 5 is a cross-sectional view showing the load keys 45 in the retracted position. FIG. 6 is a partial enlarged view of the load key 45 retracted in the housing 40. The collet 70 is an annular ring having an outer set of collet fingers and an inner set of collet fingers that are shorter than the outer collet fingers. The outer set of collet fingers is configured to engage a groove 41 in the housing 40. The inner set of collet fingers is configured to engage a groove 71 around the connector shaft 48. During run-in the collet 70 is not locked into place and is movable (also referred to as "float") relative to the retainer 60. The jam nut 80 abuts the end of the load key connecter shaft 48 and is threadedly coupled to the load key retainer 60. The holding bolt 90 includes a shoulder that abuts the jam nut 80 and a head that sets in the counter bore of the jam nut 80 and threadedly engages the connector shaft 48. The connecter shaft 48 may include bore 91 for receiving grease and a fitting 92 for closing the bore 91.

Figure 8:
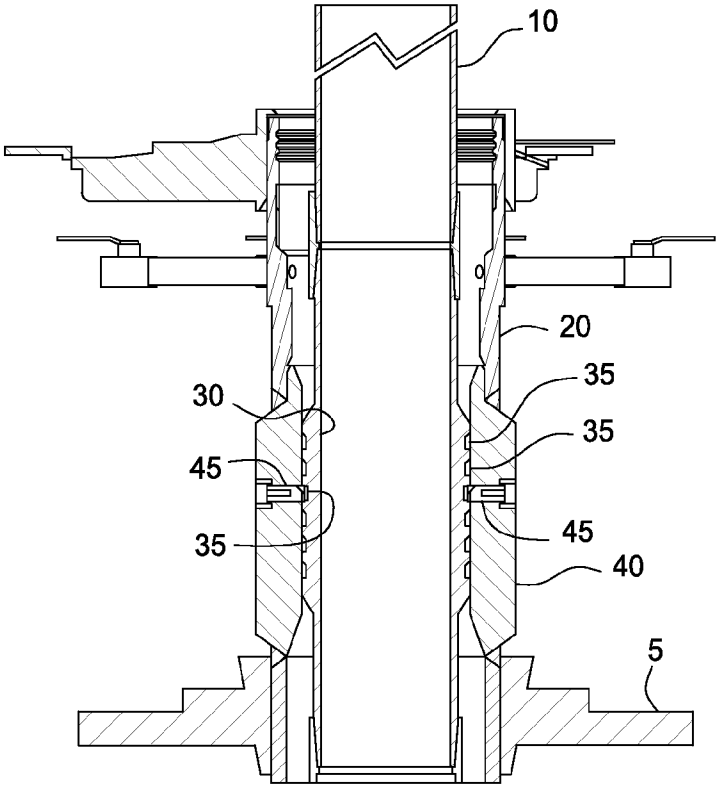
FIGS. 7-8 show the installation of the first casing in the second casing.
Figure 7:
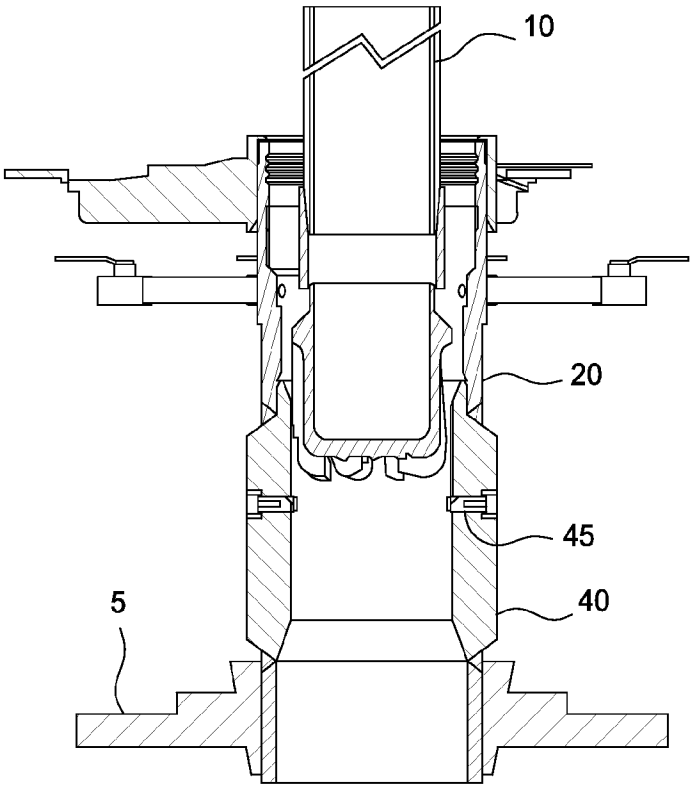

FIG. 7 shows the installation of the first casing 10 in the second casing 20. As shown, the bottom hole assembly of the first casing 10 is being lowered into the latch housing 40 of the second casing 20. The load keys 45 are in the retracted position at this time. In FIG. 8, the first casing 10 has been lowered sufficiently so that the mandrel 30 is positioned adjacent the housing 40. The plurality of slots 35 on the mandrel 30 allows the placement of the first casing 10 relative to the second casing 20 to be adjusted so a sufficient amount of the bottom hole assembly extends below the second casing 20.

Figure 10:
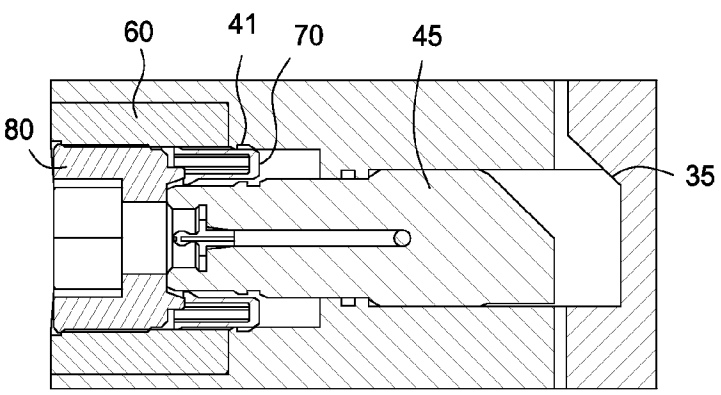
FIGS. 9-12 illustrate the operation sequence to engage the load keys to the key slots of the latch mechanism of FIG. 4.
Figure 11A:
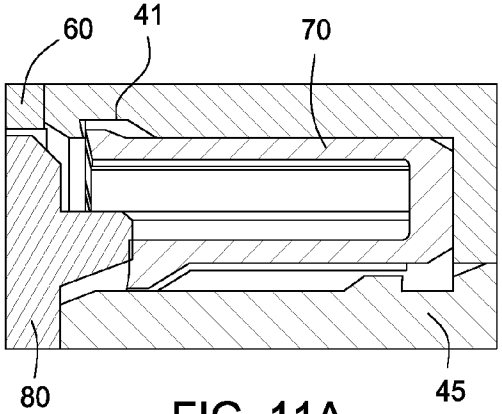
Figure 9:
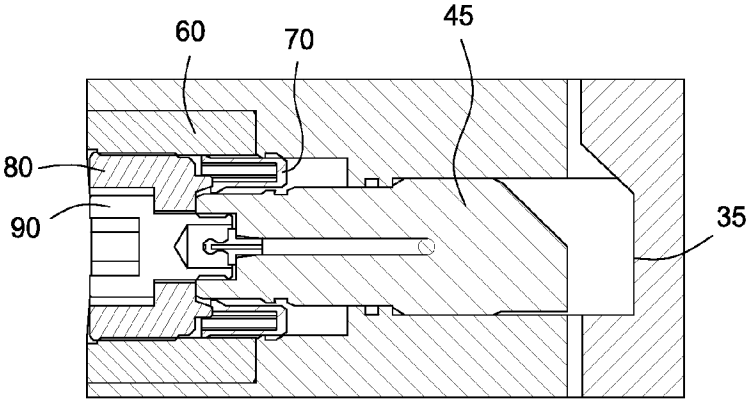
Figure 11:
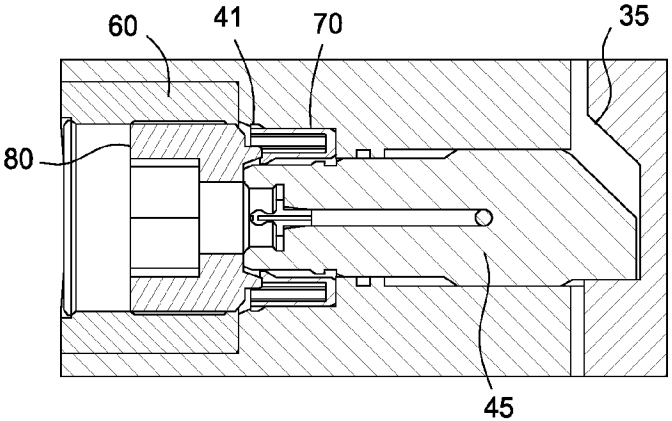
Figure 12:
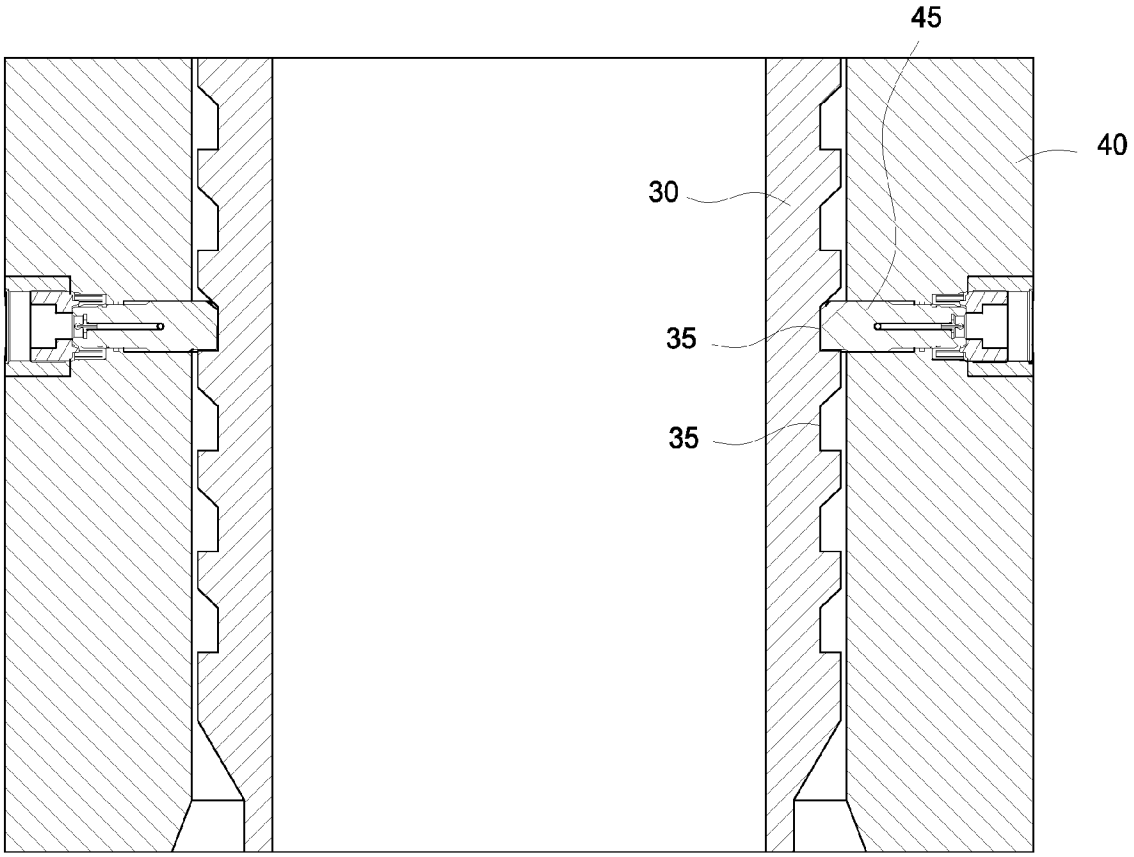

FIGS. 9-11A illustrate the operation sequence to engage the load keys 45 to the key slots 35. Initially, the appropriate key slot 35 is aligned with the load key 45, as shown in FIG. 9. Then, the holding bolt 90 is removed, as shown in FIG. 10. The jam nut 80 is then rotated to push the load key 45 into engagement with key slot 35, as shown in FIG. 11. Because of the abutment, the collet 70 is also pushed in during rotation of the jam nut 80. The collet 70 is moved sufficiently so that the outer collet fingers expand and engage the groove 41 in the housing 40, as shown in the enlarged view of FIG. 11A. FIG. 12 shows the load keys 45 of the housing 40 engaged with the key slots 35 of the mandrel 30.

Figure 13:
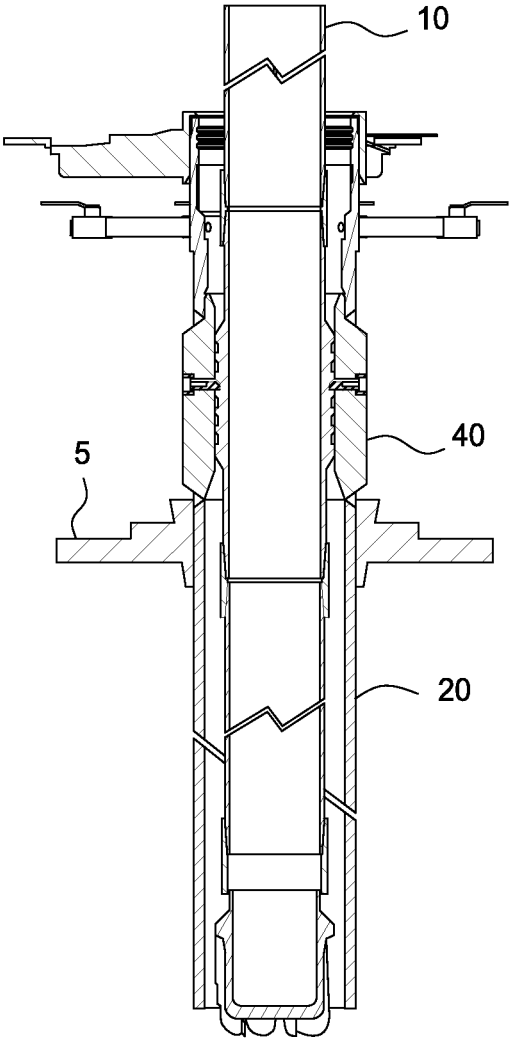
FIG. 13 shows the first casing and the second casing ready to be deployed.

FIG. 13 shows the first casing 10 and the second casing 20 ready to be deployed. The first casing 10 is lifted up from the surface table 5, and then the slips are removed. Thereafter, the first and second casings 10, 20 are lowered to the sea floor and urged through the formation. The second casing 20 may be drilled down or jetted to the desired depth, such as positioning the housing 40 at or above the mud line.

Figure 14:
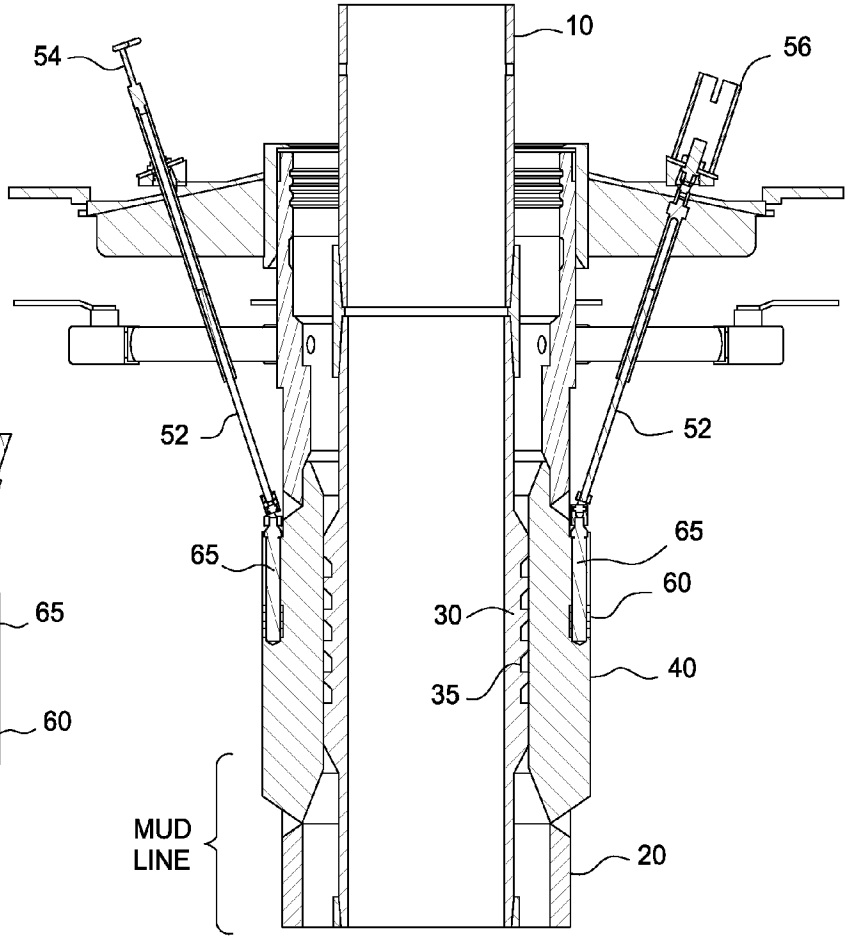
FIGS. 14-18A illustrate the operation sequence to release the first casing from the second casing.
Figure 14A:
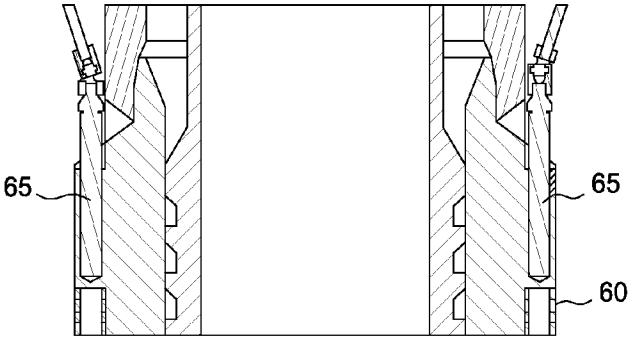
Figure 15:
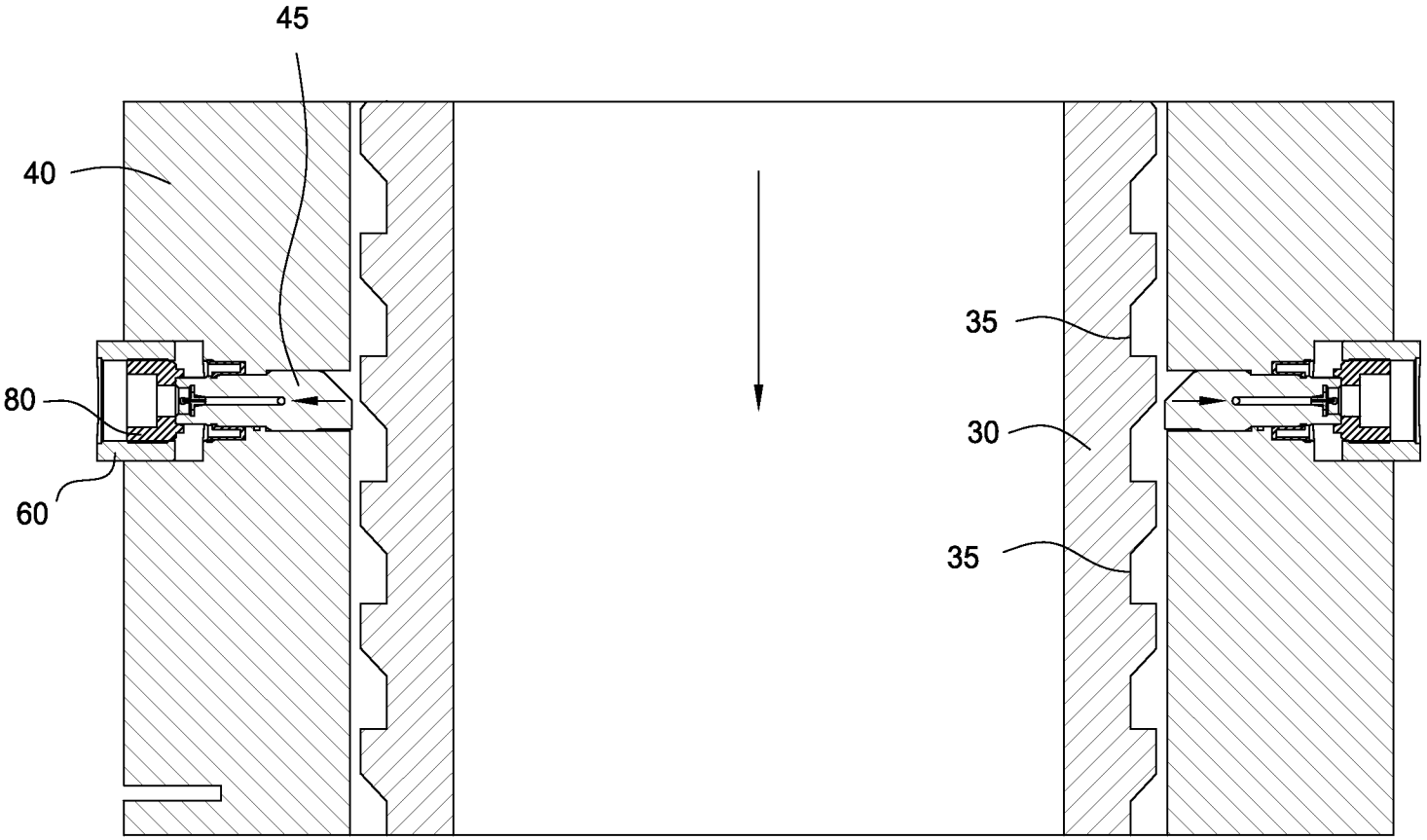
Figure 16:
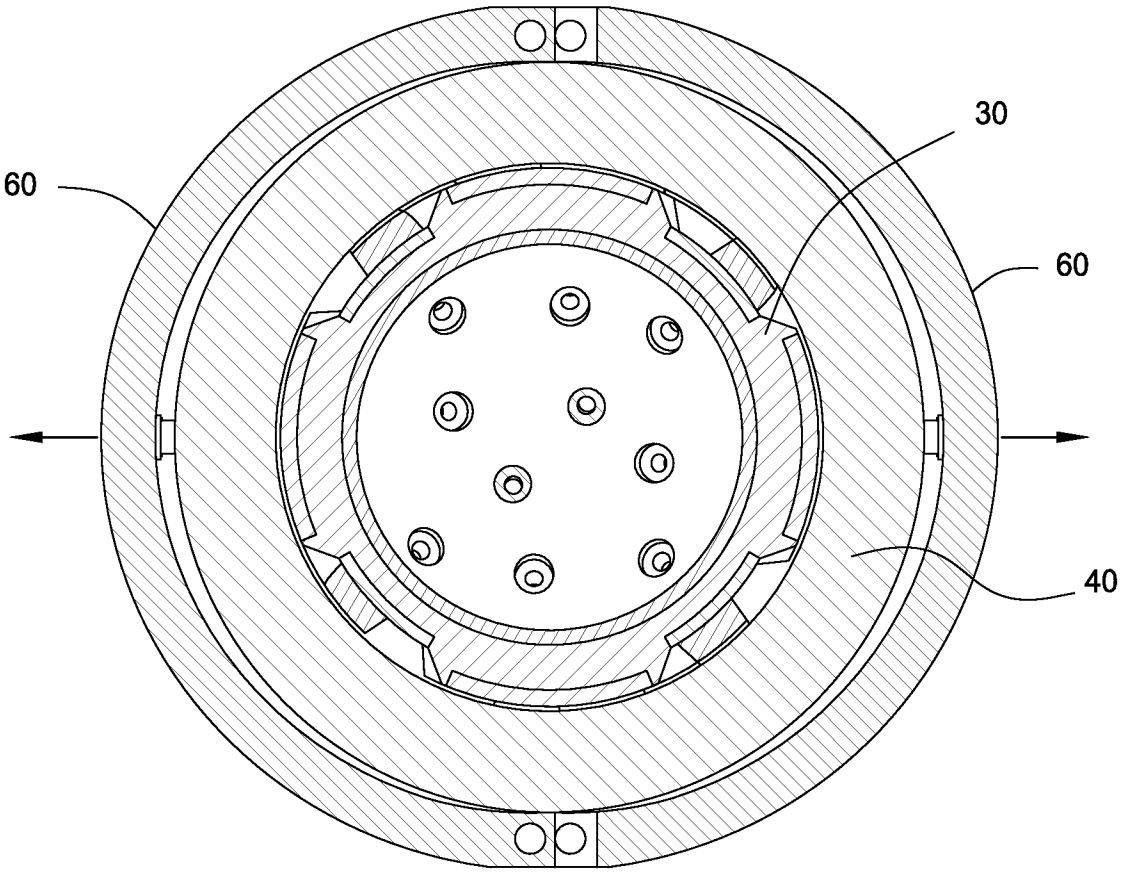
Figure 17:
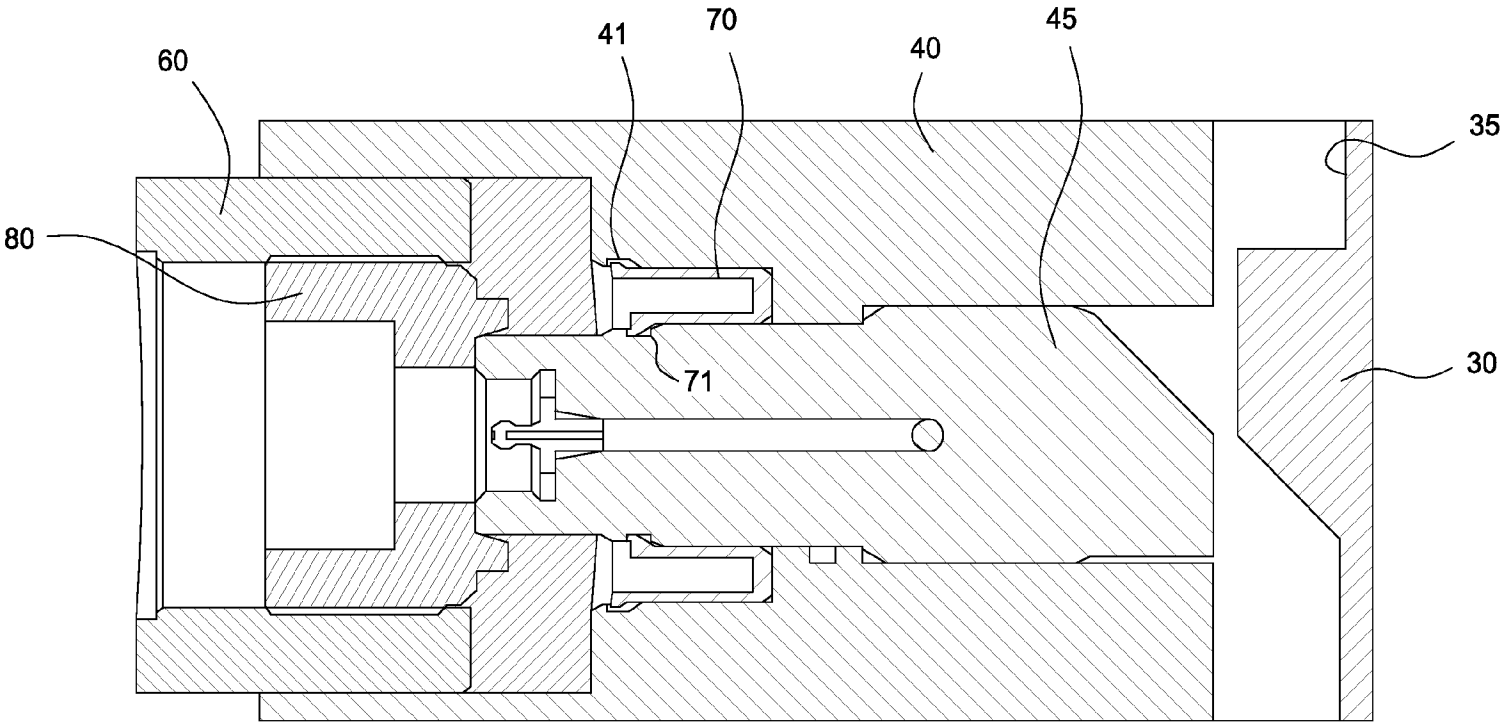
Figure 18A:
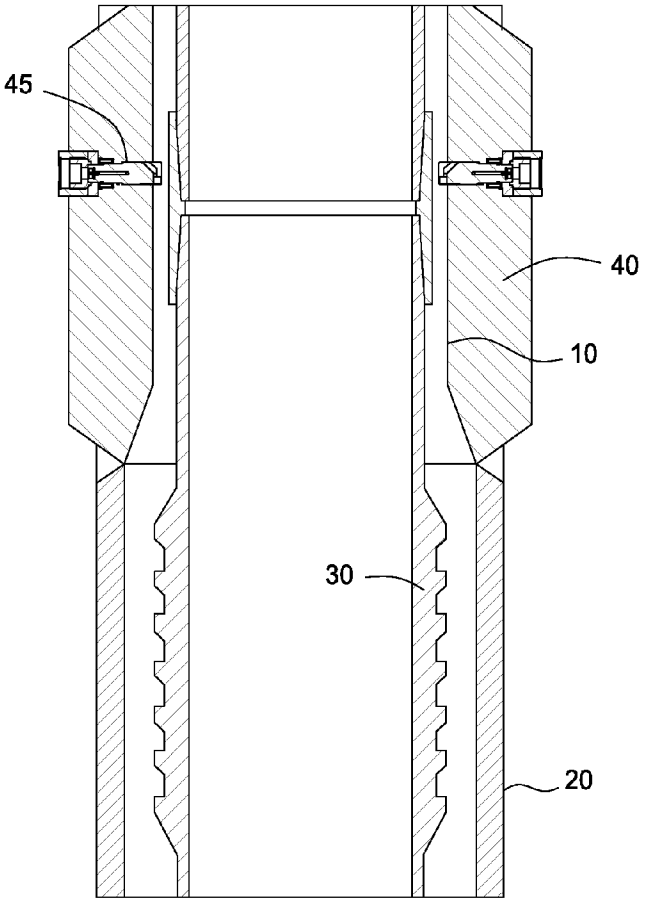
Figure 18:
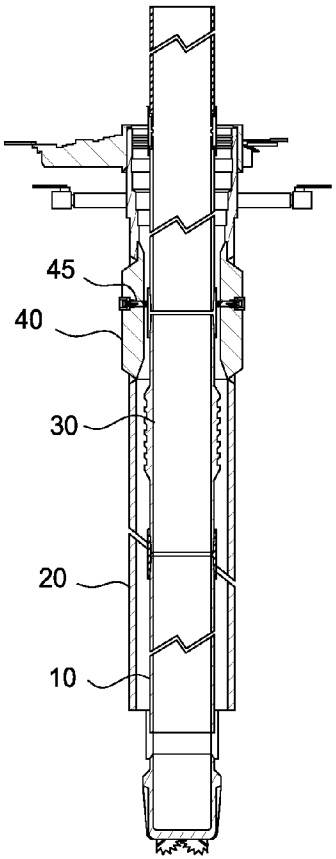

After reaching the desired depth, the first casing 10 is released from the second casing 20. As shown in FIG. 14, a ROV may be used to unscrew the retainer pin 65 by gripping the handle 54 on the telescopic member 52. In another embodiment, the ROV may use a torque tool to engage the torque tool receiver 56 and to rotate the telescopic member 52. Rotation of the retainer pin 65 relative to the housing 40 pulls the retainer pin 65 from the hinges on the segments of the retainer 60. FIG. 14A shows the retainer pin 65 disengaged from the retainer 60. After the pin 65 is released, a downward force is applied to the first casing 10, which in turn, pushes the load keys 45 radially outward, as shown in FIG. 15. Outward movement of the load keys 45 also pushes out the jam nut 80 and the retainer 60. FIG. 16 is a cross-sectional view showing the separation of the hinges of two retainer segments 60. FIG. 17 is an enlarged view of the load key 45 after retraction. The load key 45 has retracted sufficiently to allow the inner collet fingers to engage the groove 71 on the load key 45. Engagement of the outer and inner collet fingers to their respective grooves 41, 71 holds the load key 45 in the retracted position. After release from the second casing 20, the first casing 10 may continue to drill down, as shown in FIG. 18, 18A.

Figure 19:
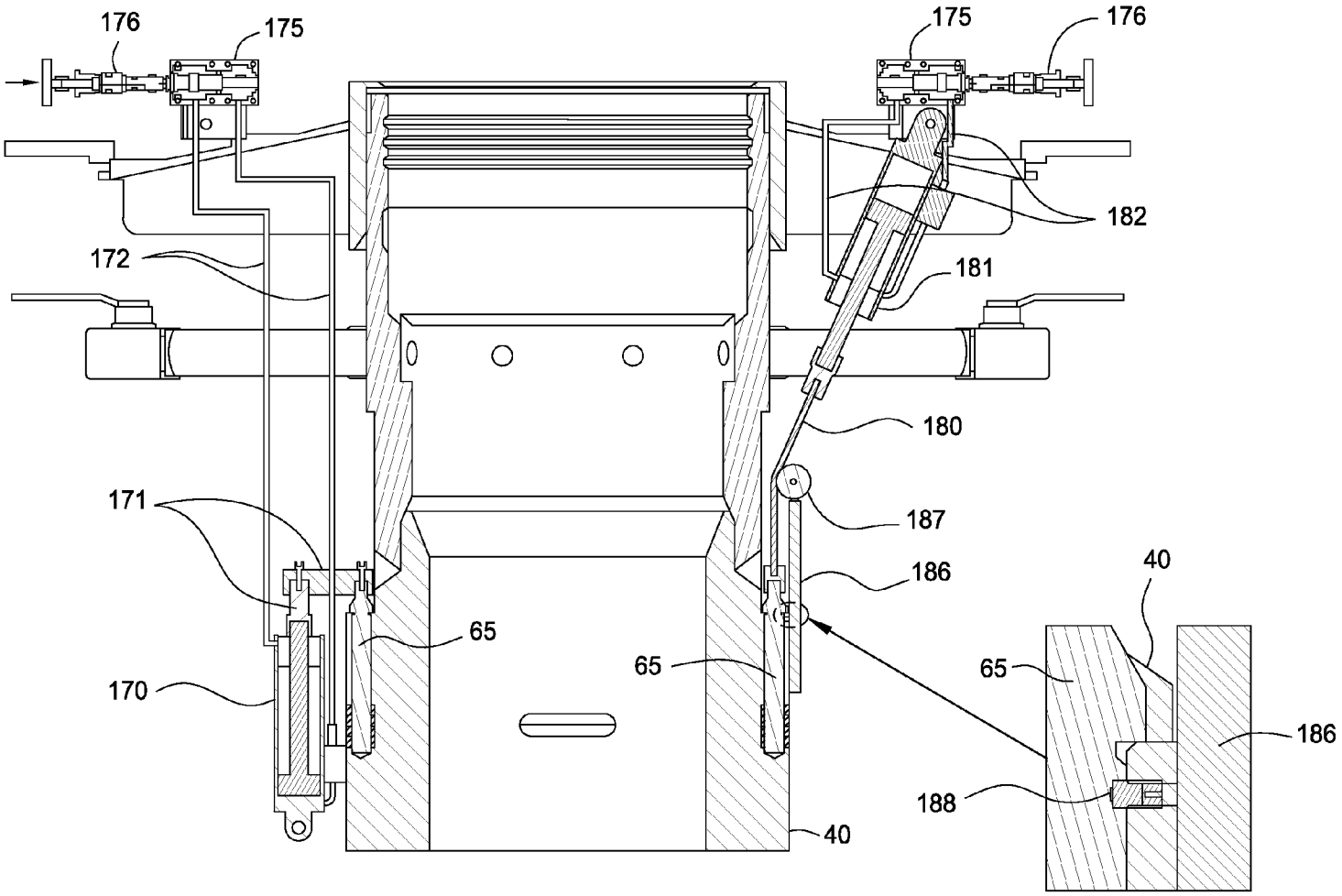
FIG. 19 illustrates two additional embodiments for releasing the retainer pin.

FIG. 19 illustrates two additional embodiments for releasing the retainer pin 65. Both embodiments are operated using hydraulics. Referring to the embodiment on the left side of FIG. 19, the retainer pin 65 is coupled to and moveable with a hydraulic piston 170. In one embodiment, an adapter block 171 is used to couple the retainer pin 65 to the piston 170. Hydraulic fluid to operate the piston 170 may be supplied by hydraulic lines 172 from a hydraulic manifold 175. The manifold 175 is configured to receive a stab member 176 controlled by a ROV. In operation, the ROV inserts the stab member 176 into the manifold 175. To release the pin 65, hydraulic fluid is supplied through the hydraulic line 172 configured to lift the piston 65. The retainer pin 65 is lifted out of the retainer 60 as the piston 170 is lifted by the hydraulic fluid.

Referring now to the embodiment on the right side of FIG. 19, a cable 180 is connected between the retainer pin 65 and a hydraulic piston 181. Hydraulic fluid to pull the piston 181 may be supplied by hydraulic lines 182 from a hydraulic manifold 175. The manifold 175 is configured to receive a stab member 176 controlled by a ROV. The retainer pin 65 is also releasably coupled to a steel cable 180. In one embodiment, a shearable member such as a shear pin 188 is used to couple the retainer pin 65 to the latch housing 40. The guide support 186 is attached to the housing 40 and includes a roller guide 187 for the cable 180. In operation, the ROV inserts the stab member 176 into the manifold 175. To release the pin 65, hydraulic fluid is supplied through the hydraulic line 182 configured to lift the piston 181. The piston 181 supplies a sufficient upward force to shear the shear pin 188, thereby allowing the retainer pin 65 to be lifted out of the retainer 60.

Latch Concept 2

Figure 20:
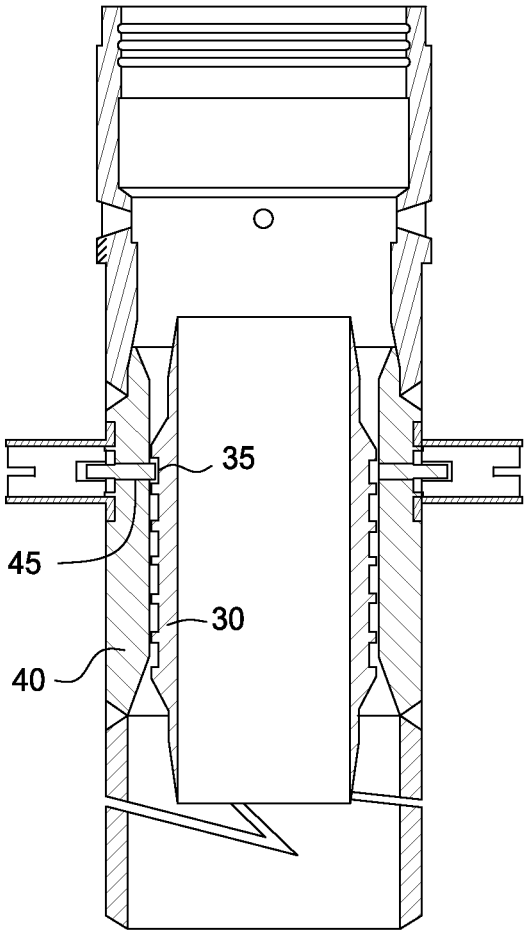
FIGS. 20-22 illustrate another embodiment of a latch mechanism.
Figure 21:
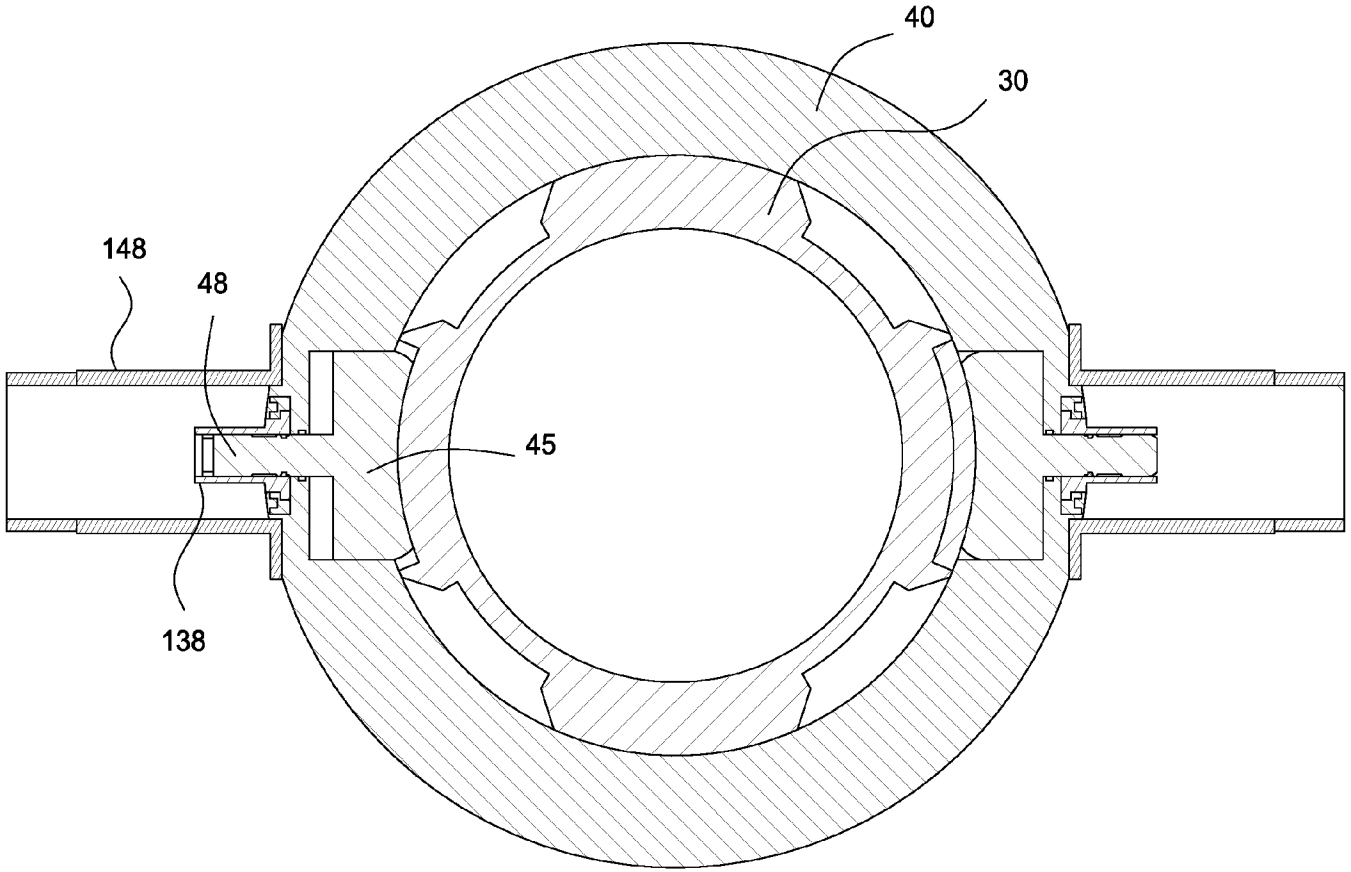
Figure 22:
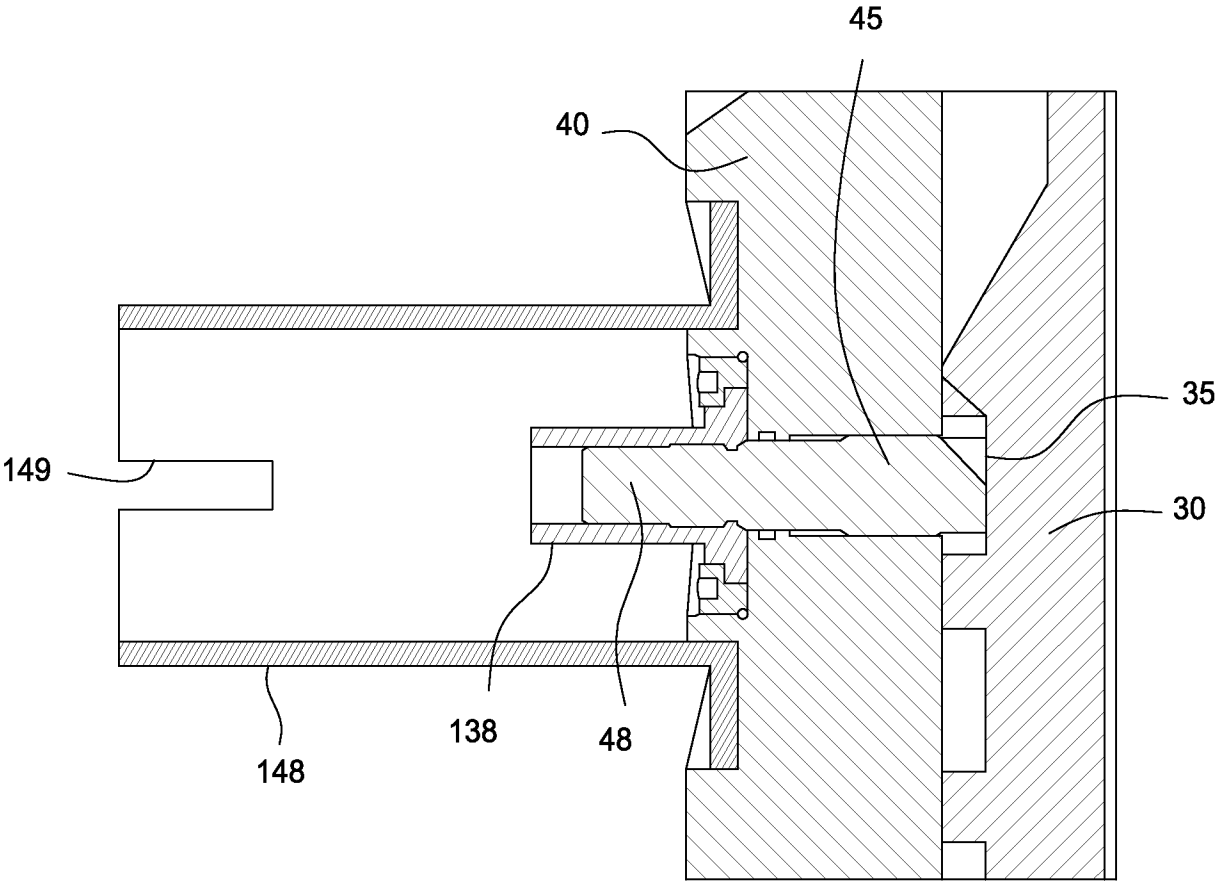

FIGS. 20-22 illustrate another embodiment of a latch mechanism 200 for engaging and disengaging the load keys 45 from the key slots 35. FIG. 20 shows the mandrel 30 coupled to the housing 40 via the load keys 45 and the key slots 35. The coupling may be performed at the surface using standard tools. At the mud line, an ROV can use a torque tool to disengage the load key 45. An exemplary torque tool is a torque tool class 1-4 commercially available from Oceaneering.

FIG. 21 is a cross-sectional view of the mandrel 30 coupled to the housing 40 via the load key 45. FIG. 22 is a partial cross-sectional side view of the mandrel 30 coupled to the housing 40 via the load key 45. As seen in these Figures, the connector shaft 48 of the load key 45 is coupled to an adjustment nut 138, wherein rotation of the adjustment nut 138 causes radial movement of the load key 45. The adjustment nut 138 is disposed in the bore of a torque tool receiver 148 connected to the housing 40. The torque tool receiver 148 may include an engagement slot 149 for engaging a torque tool. At the surface, the torque tool or other tools may be used to rotate the adjustment nut 138 to cause the load key 45 to move radially inward into engagement with the slot 35 of the mandrel 30. After the second casing 20 reaches the desired depth, the ROV may operate a torque tool to engage the torque tool receiver 148 and the adjustment nut 138, which then can be rotated to retracted the load key 45, thereby freeing the first casing 10 to continue drilling.

Latch Concept 3

Figure 23:
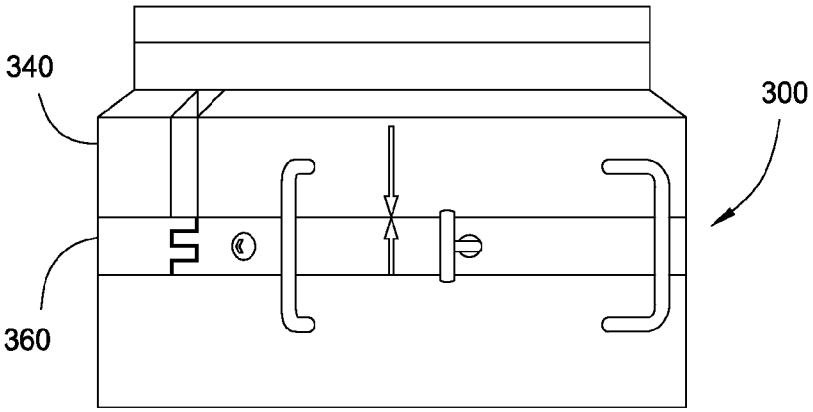
FIGS. 23-33 illustrate another embodiment of a latch mechanism.
Figure 24:
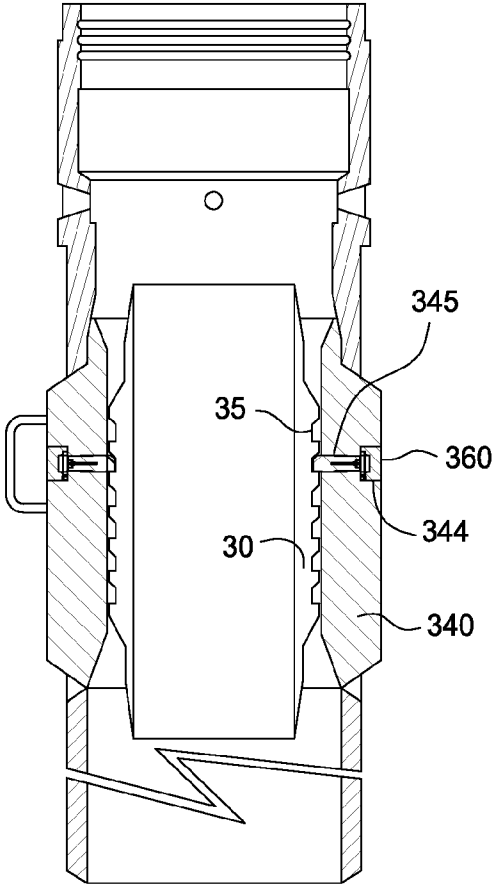

FIG. 23 illustrate another embodiment of a latch mechanism 300 for engaging and disengaging the load keys 345 from the key slots 35. In this embodiment, a retainer ring 360 is disposed around the housing 340 and may include two or more arcuate segments hinged together. The retainer ring 360 may be rotatable relative to the housing 340 and may optionally be disposed in a groove 344 in the housing 340. FIG. 24 is a cross-sectional view showing the retainer ring 360 in a groove 344 and the load key 345 engaged with the key slot 35 of the mandrel 30.

Figure 25:
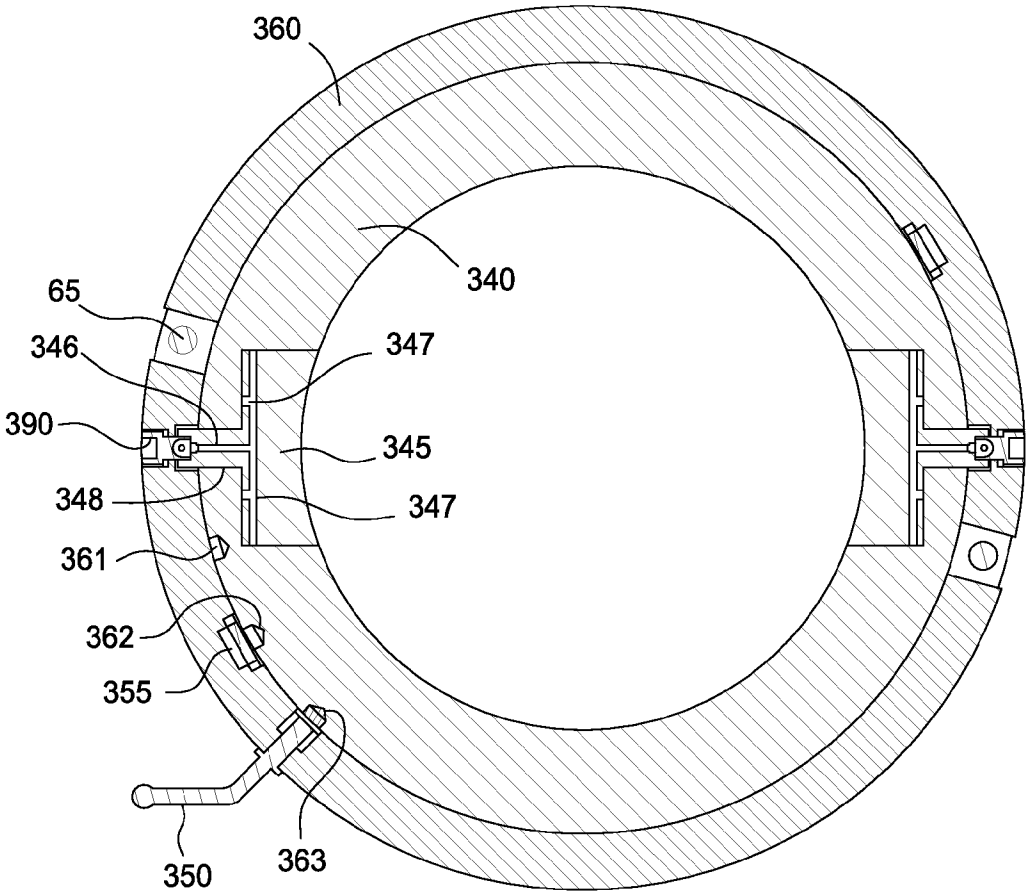
Figure 26:
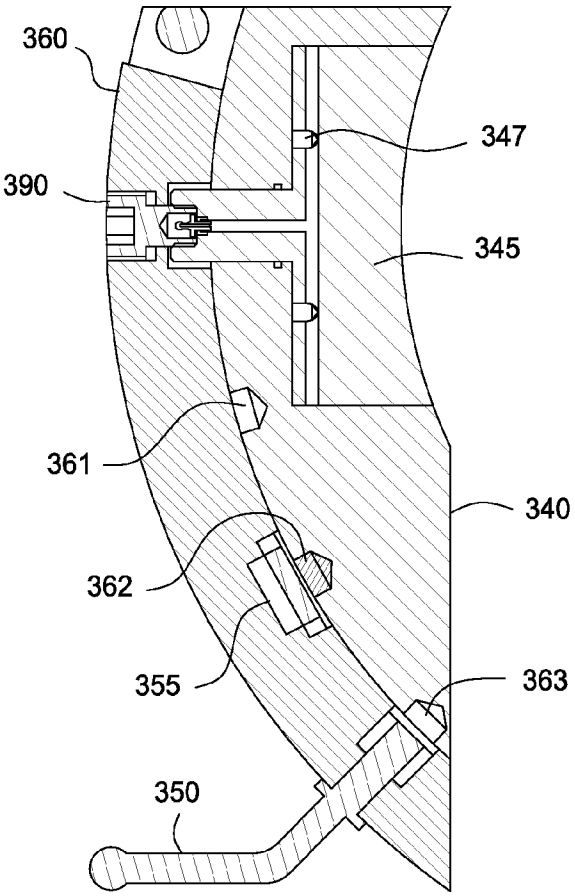
Figure 26A:
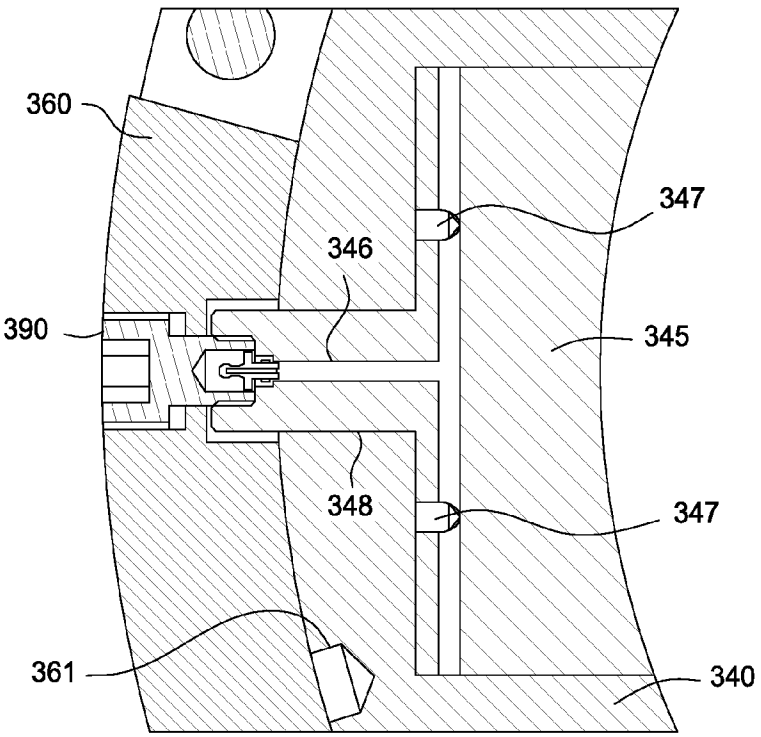

FIG. 25 is a cross-sectional view of the retainer ring 360 and the load key 345 in the housing 340. FIGS. 26 and 26A are enlarged partial views of FIG. 25. The load key 345 is shown in the retracted position and ready to receive the slots 35 of the mandrel 30. A lock bolt 390 is used to keep the load key 345 in the retracted position. Using the load key 345 as a reference point, i.e., 0° position, the outer surface of the housing 340 may include at least three receiving openings 361, 362, 363 for receiving a position setting pin 350. In one embodiment, the receiving openings 361-363 are spaced 15° degrees apart. The setting pin 350 is mated with the third receiving openings 363 when the lock bolt 390 is engaged with the load key 345. A load key catch 355 may be positioned in the retainer ring 360 adjacent the second receiving opening 362. The load key catch 355 is configured to receive and hold the connector shaft 348 of the load key 345. In one embodiment, the load key catch 355 is a ring adapted to frictionally hold the load key 345. The number of load key catches 355 may correspond to the number of load keys 345. The connector shaft 348 of the load key 345 includes a bore 346 that is connected to a network of channels 347 in the load key 345. Grease or other fluid may be supplied through the bore 346 to the channels 347 in order provide grease between the load key 345 and the housing 340. A grease fitting may be used to facilitate injection of grease into the bore 346.

Figure 27:
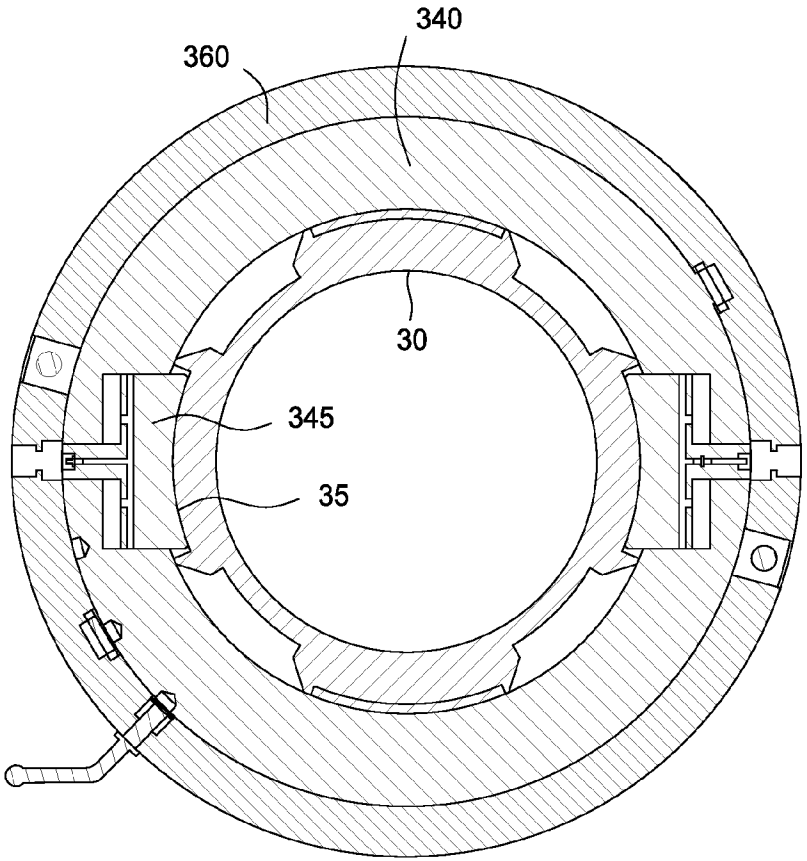
Figure 27A:
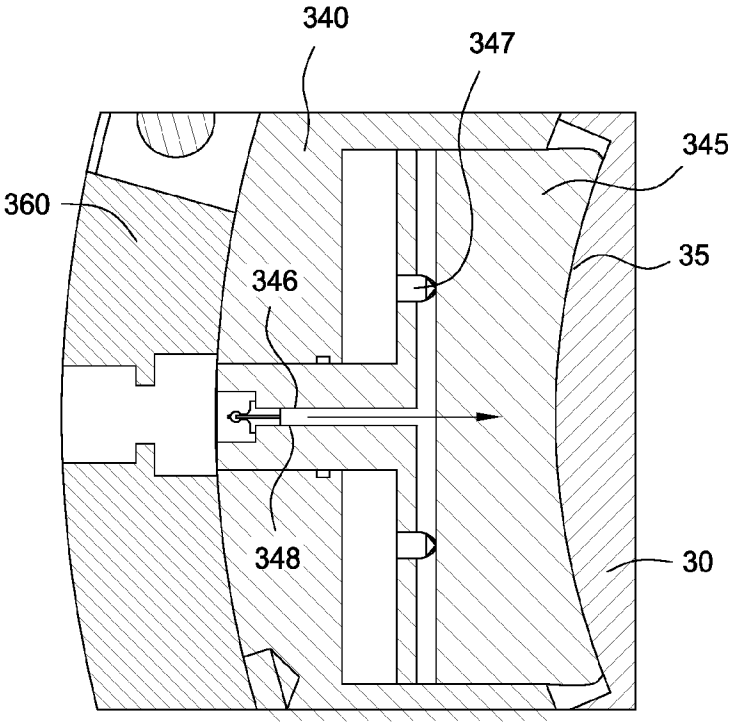
Figure 28A:
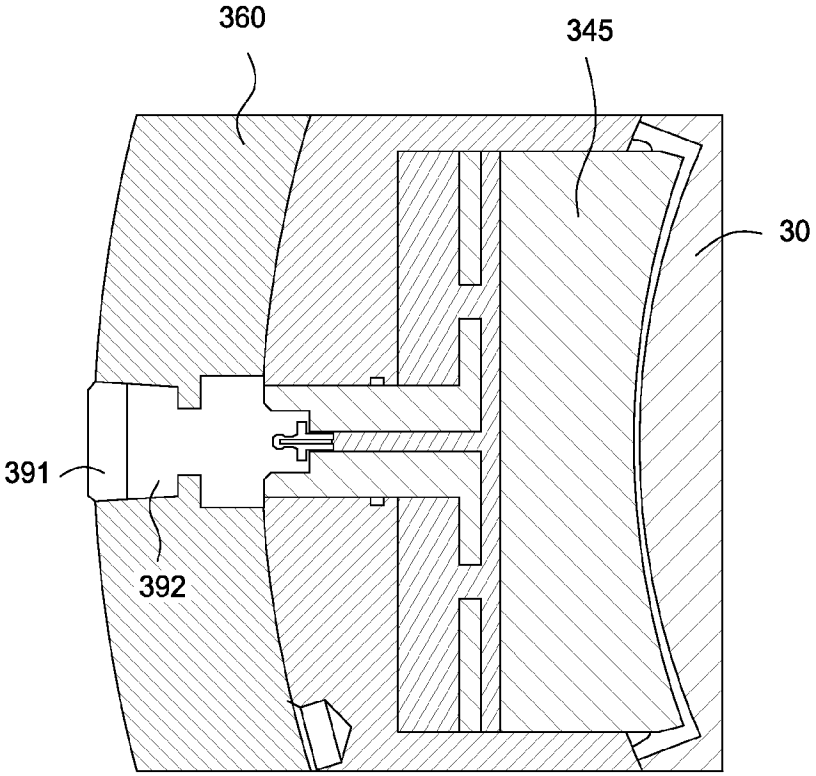
Figure 28:
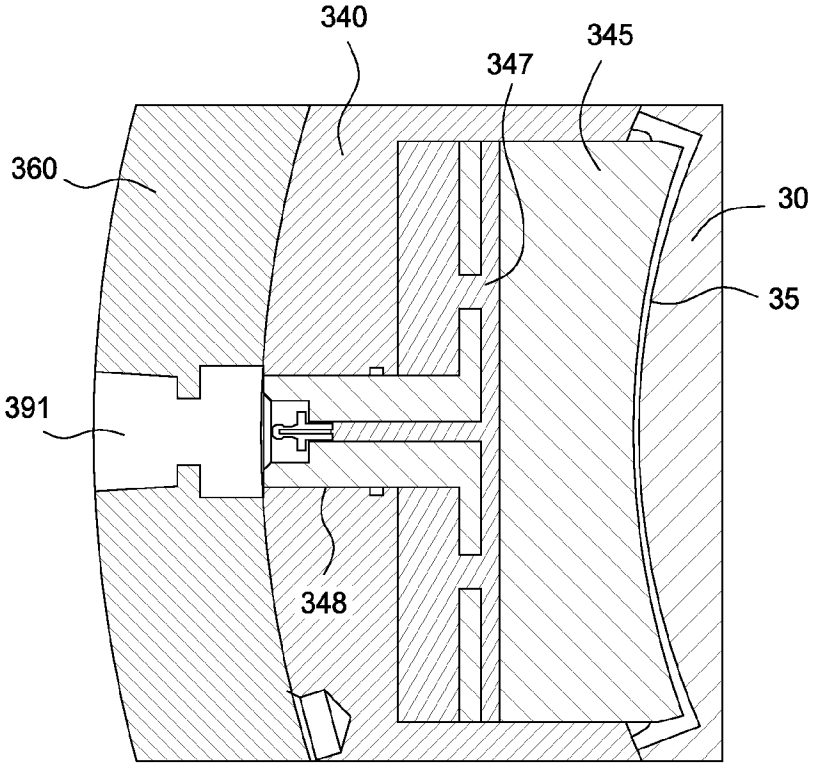
Figure 29:
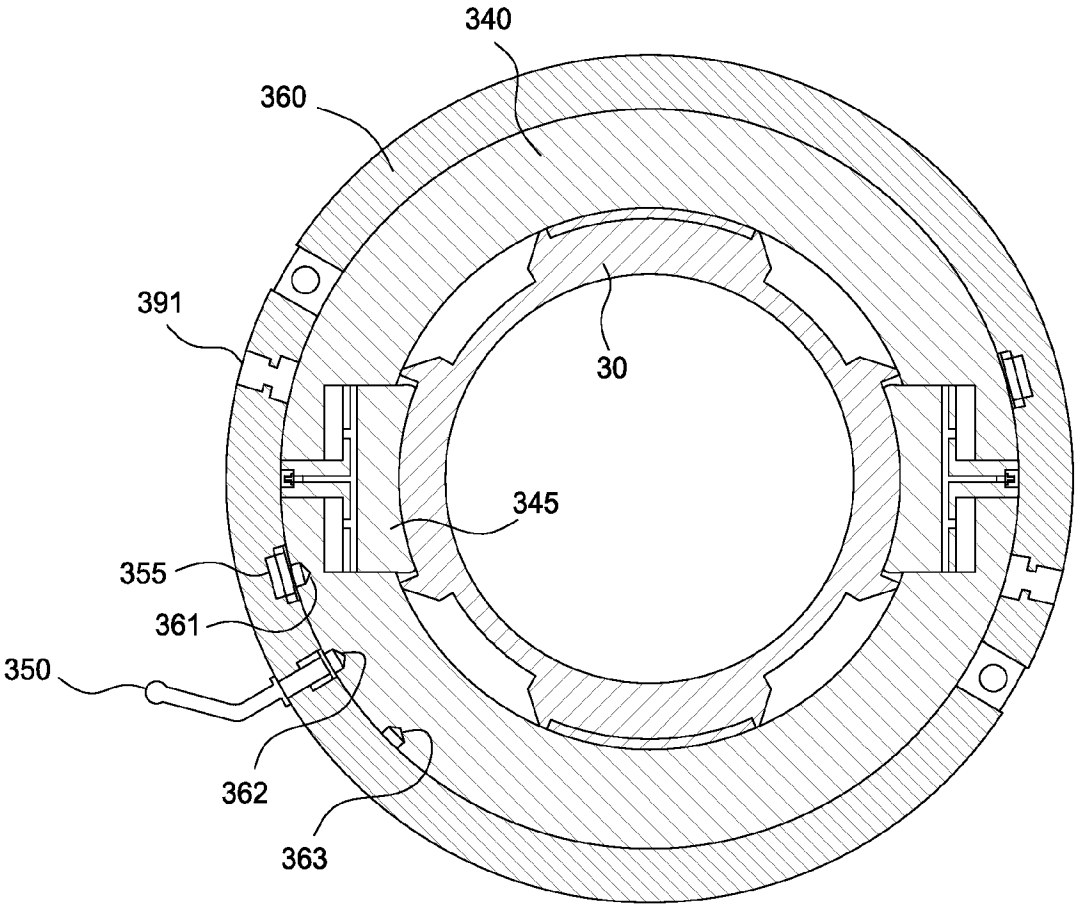

FIG. 27 is a cross-sectional view showing the mandrel 30 (and first casing 10) inserted into the housing 340 (and second casing 20), which may take place in the moon pool of a vessel such as a rig or ship. After the key slots 35 are aligned with the load key 345, lock bolt 390 is removed and the load keys 345 are moved radially into engagement with the key slot 35, as shown in FIGS. 27 and 27A. Thereafter, grease may injected through the fitting and into the bore 346 and the network of channels 347, as shown in FIG. 28. The grease may fill the space between the load key 345 and the housing 340. Optionally, as shown in FIG. 28A, additional grease may be provided in the pocket 391 in the retainer ring 360 used to accommodate the lock bolt 390. A plug 392 may be used close off the pocket 391. Referring to FIG. 29, after supplying the grease, setting pin 350 is disengaged from the third receiving opening 363. The retainer ring 360 is then rotated so that the setting pin 350 is allowed to engage the second receiving opening 362. As shown in FIG. 29, the retainer ring 360 has rotated 15 degrees and the setting pin 350 has engaged the second receiving opening 362. As a result of the rotation, the pocket 391 is moved away from the load key 345 and the load key 345 is prevented from retraction. The first casing and the second casing may now be released from the slips and drilled or jetted into the formation.

Figure 30:
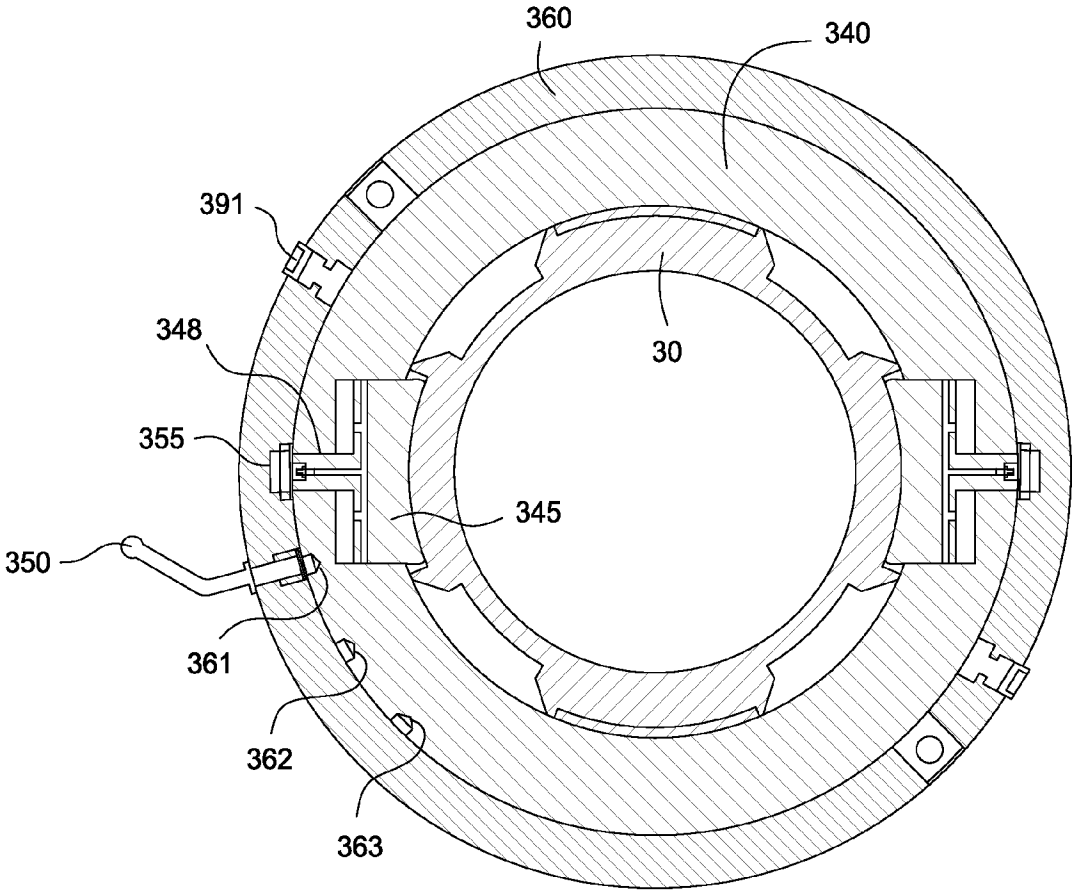

After reaching the target depth for the second casing, the mandrel 30 is released from the housing 340. To do so, a ROV is used to manipulate the setting pin 350 and the retainer ring 360. The setting pin 350 is disengaged from the second receiving opening 362, and the retainer ring 360 is then rotated so that the setting pin 350 is allowed to engage the first receiving opening 361. As shown in FIG. 30, the retainer ring 360 has rotated 15 degrees and the setting pin 350 has engaged the first receiving opening 361. As a result of the rotation, the load key catch 355 has moved adjacent to the connector shaft 348 of the load key 345.

Figure 31:
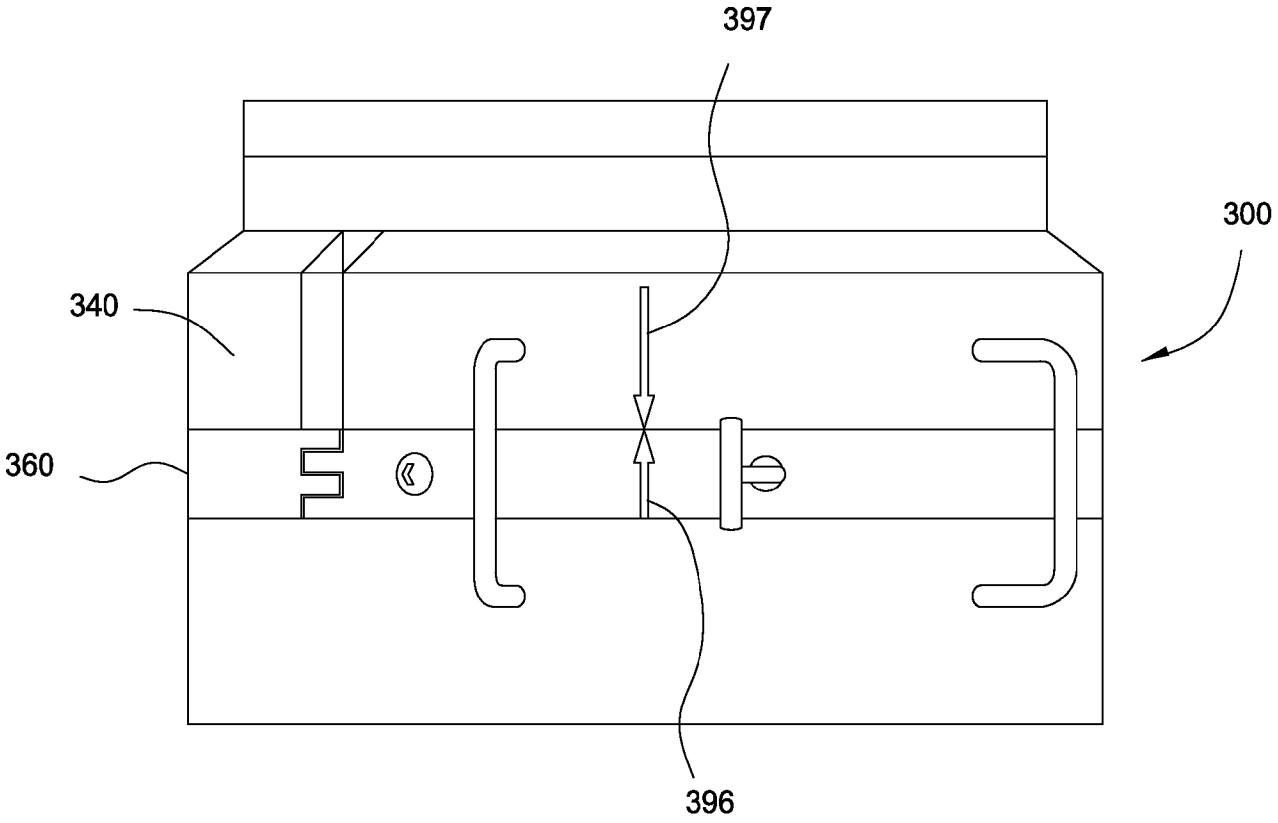
Figure 32:
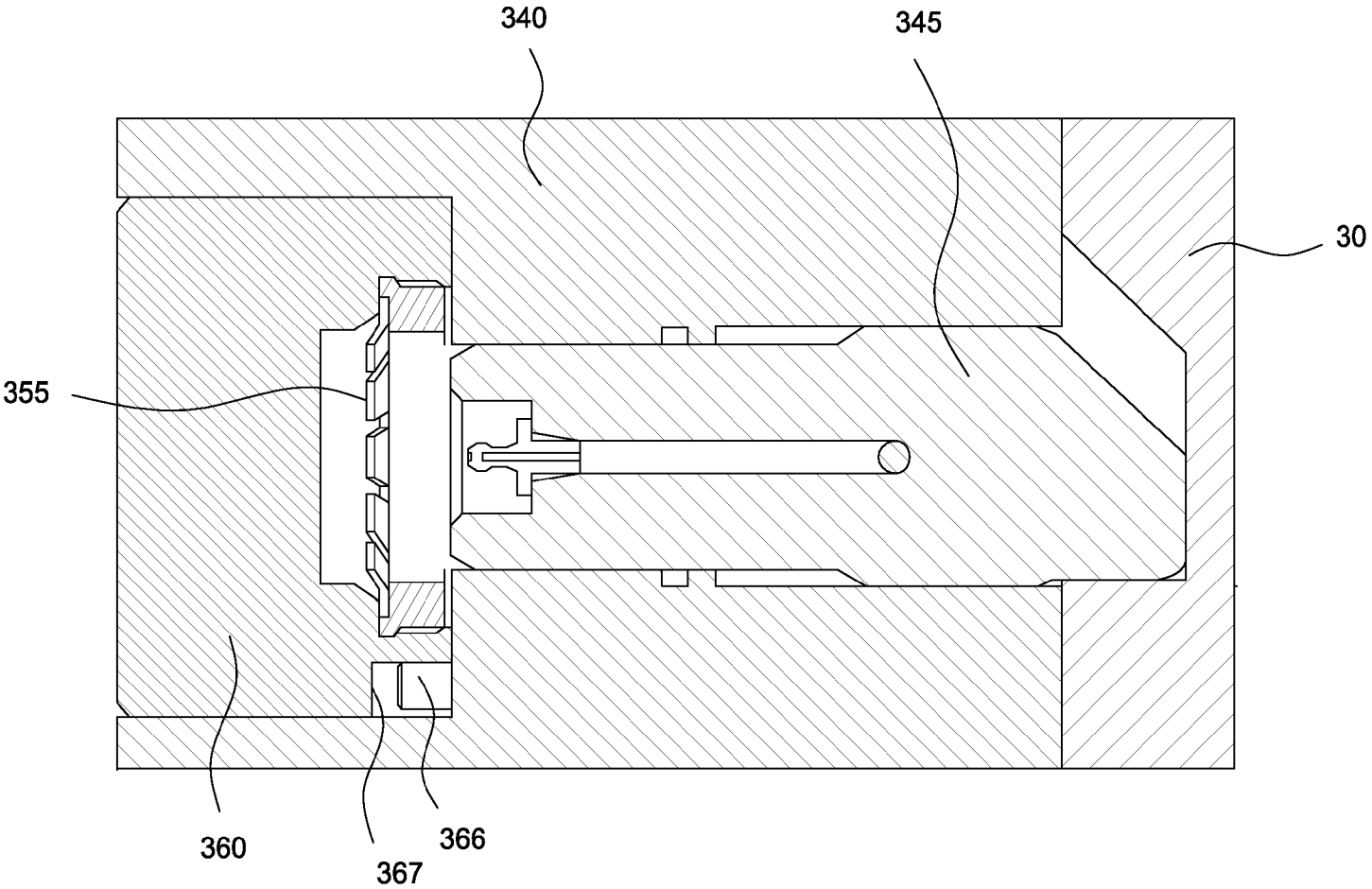

In one embodiment, to ensure the position of the retainer ring 360 is proper, a visual indicator such as arrows 396, 397 may provided on the exterior surface of the housing 340 and the retainer ring 360, as shown in FIG. 31. In another embodiment, an optional stop pin 366 may be used, as shown in FIG. 32. The stop pin 366 may be provided in a slot 367 formed in the retainer ring 360. The end of the slot 367 is arranged to correspond to the proper position of the retainer ring 360 relative to the load key 345.

Figure 33:
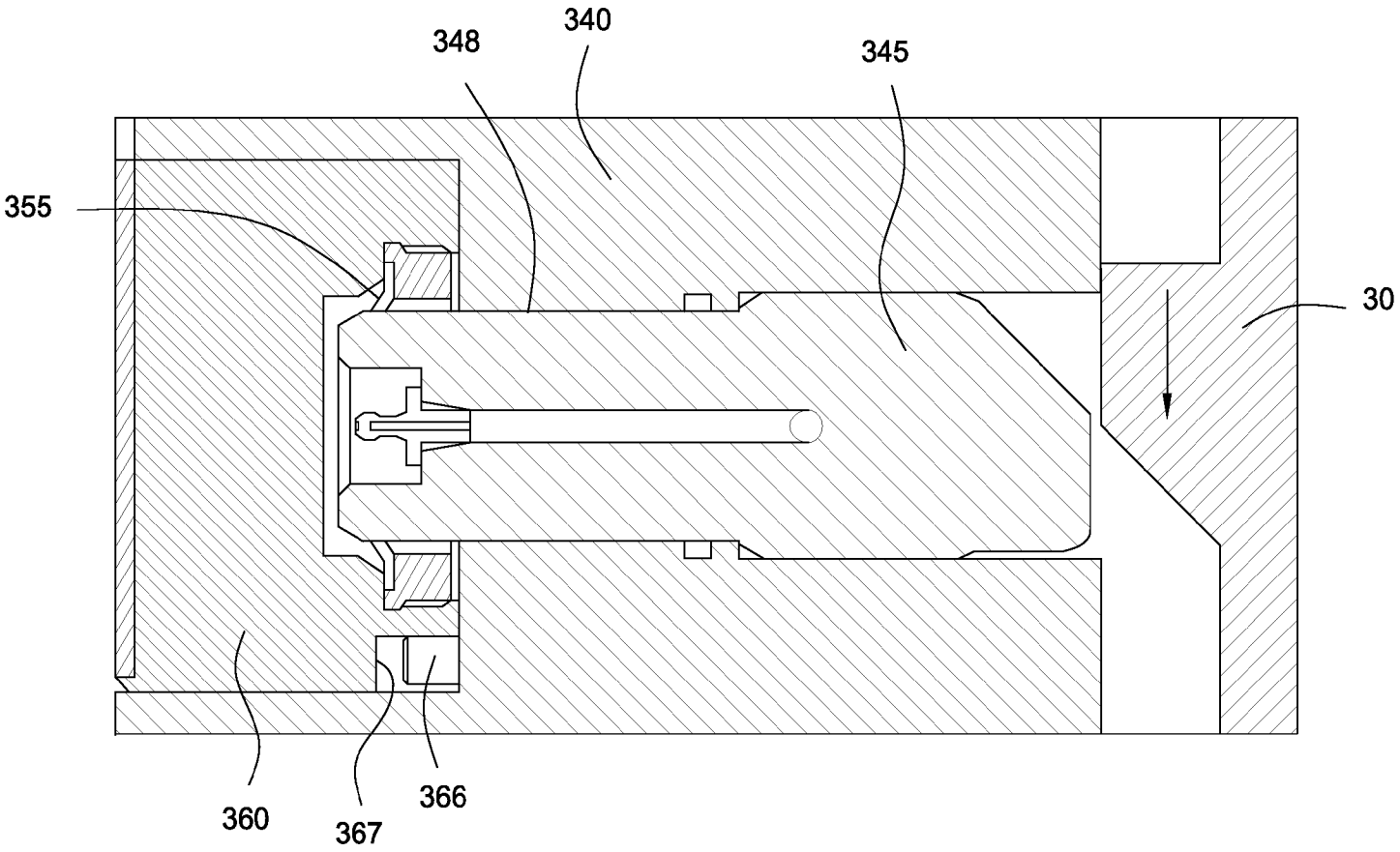

After the load key catch 355 is in position, a downward force is applied to the first casing 10, which in turn, pushes the load keys 345 radially outward, as shown in FIG. 33. The connector shaft 348 of the load keys 345 is urged into engagement with the load key catch 355, as shown in FIG. 33. It can be seen the load key 345 has been retracted into the housing 340 and the mandrel 30 is free to move downward.

Latch Concept 4

Figure 34:
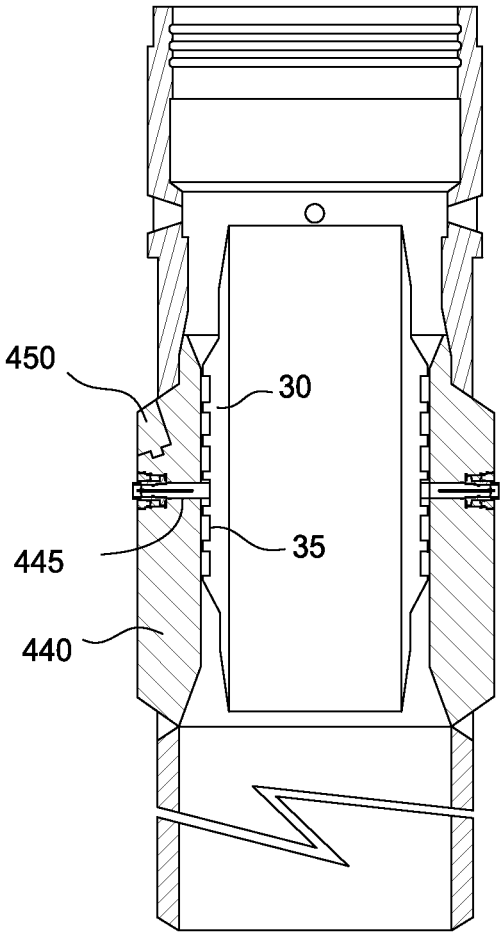
FIGS. 34-38 illustrate another embodiment of a latch mechanism.
Figure 35:
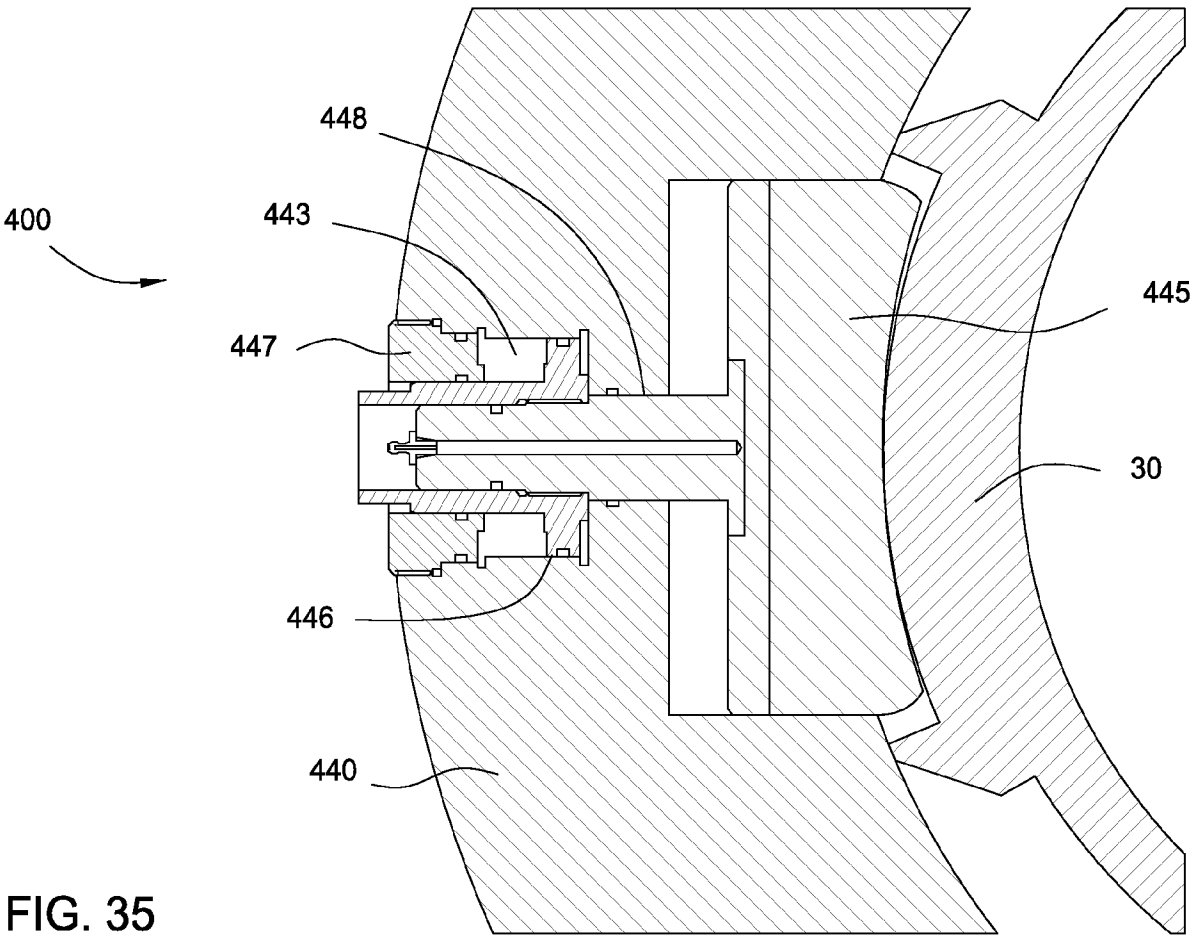

FIG. 34 illustrate another embodiment of a latch mechanism 400 for engaging and disengaging the load keys 445 from the key slots 35. In this embodiment, the load key 445 is actuated using hydraulics. As shown in FIG. 35, the connector shaft 448 of the load key 445 is connected to and movable with a piston 446. The piston 446 is retained a chamber 443 of the housing 440 using a stop nut 447. As shown, the piston 446 is located at the distal end of the chamber 443, which positions the load key 446 in the extended position and engaged to the key slot 35 of the mandrel 30.

Figure 36:
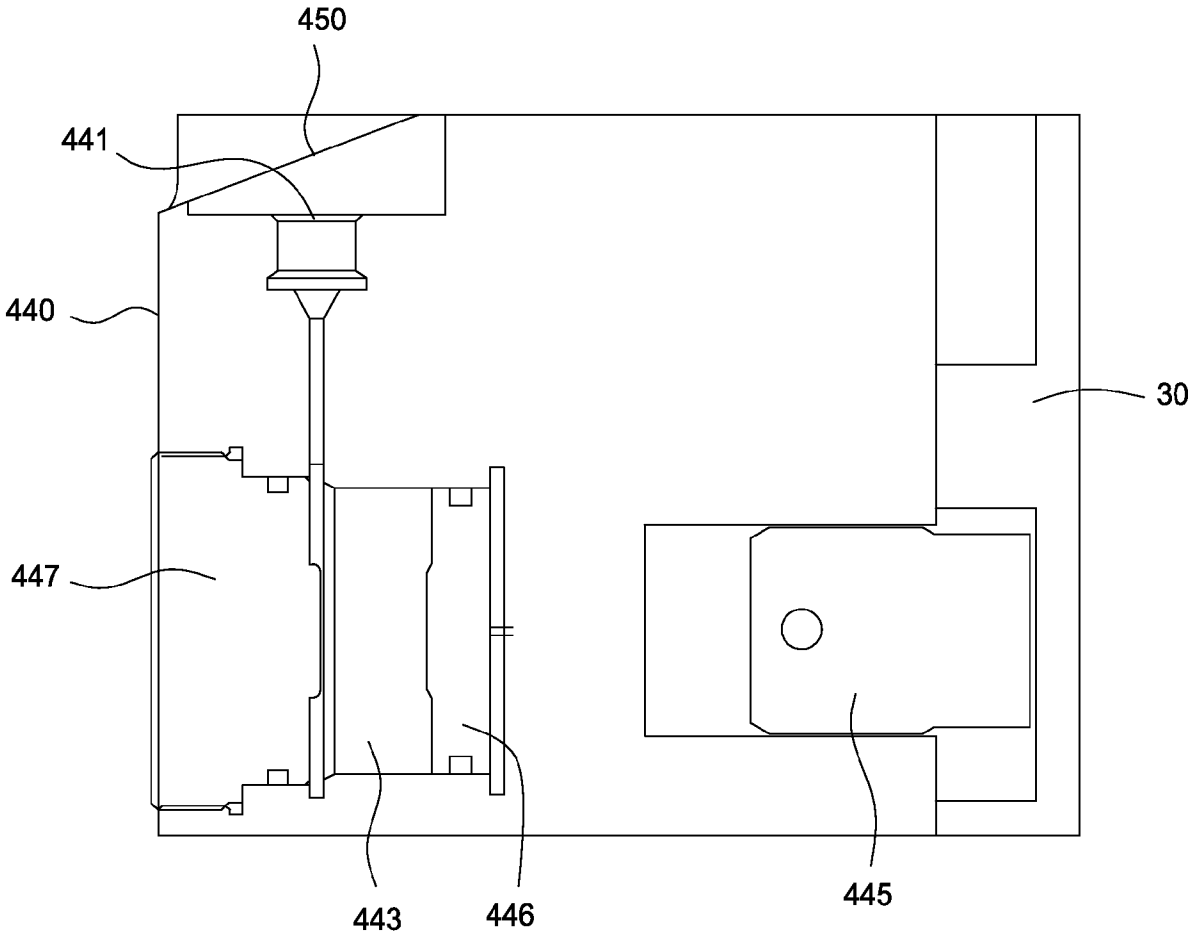
Figure 37:
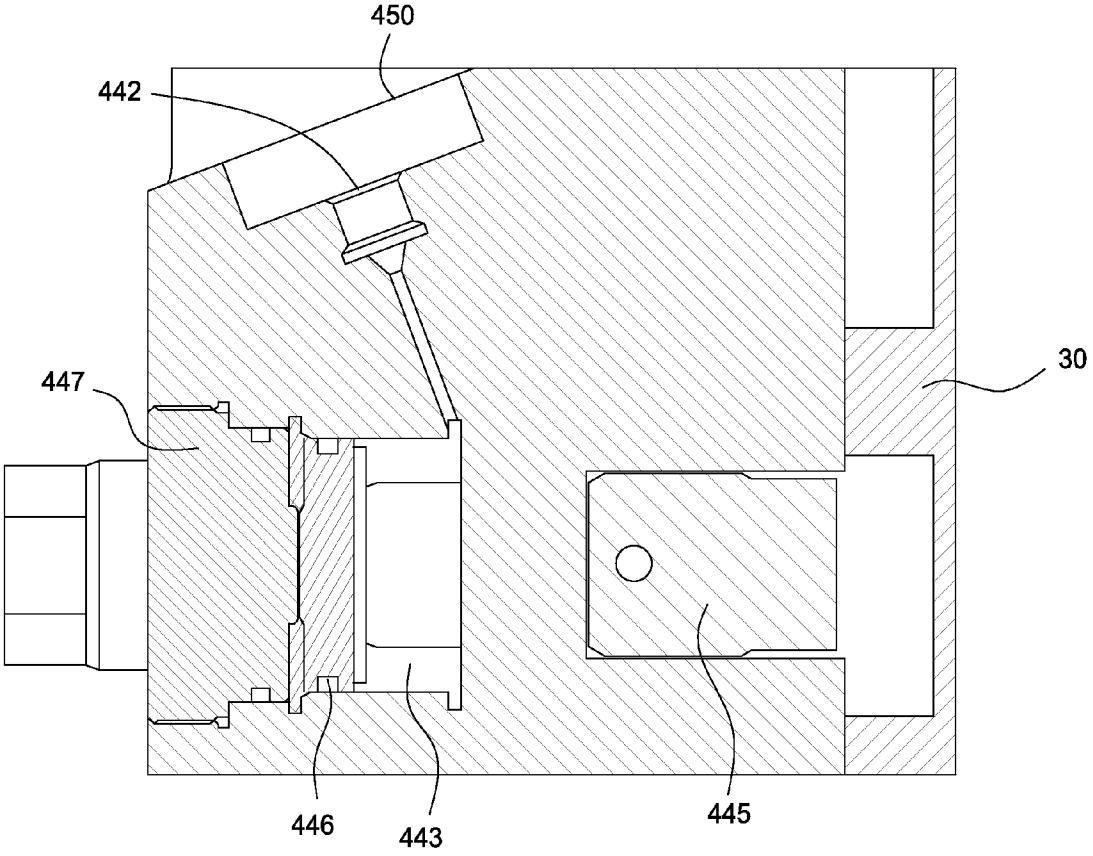
Figure 38:
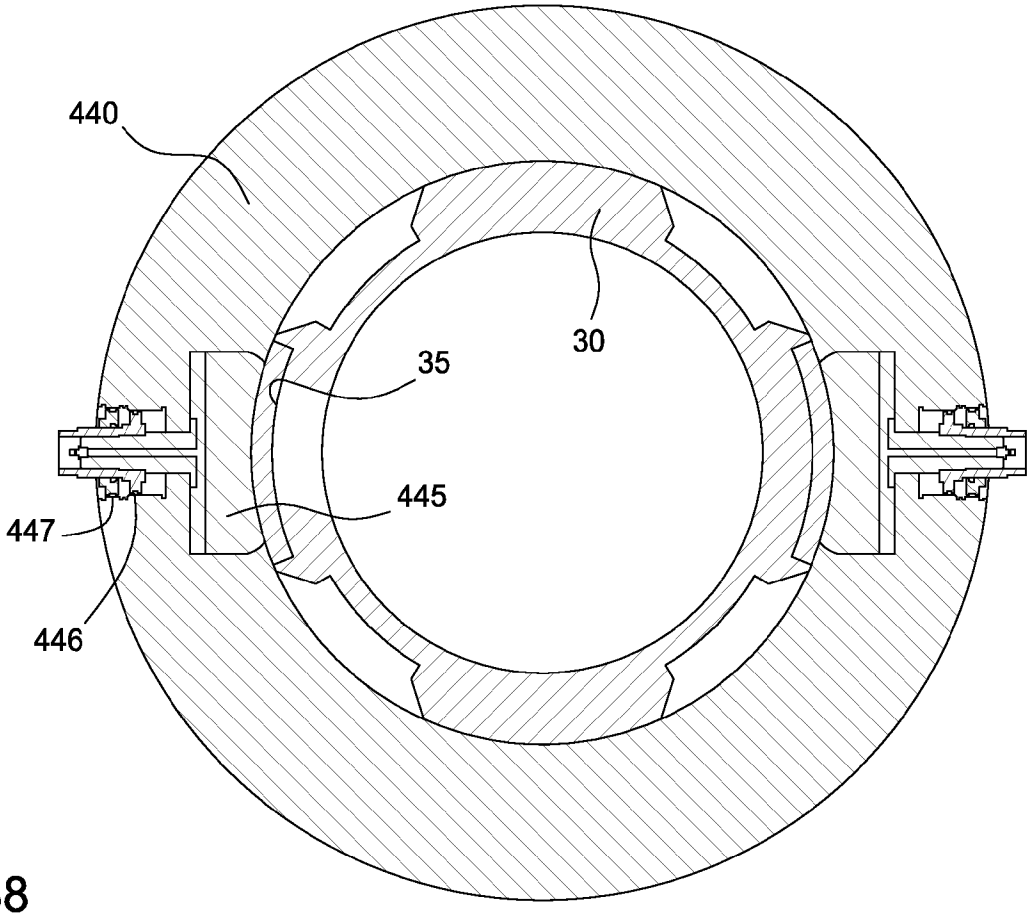
Figures 39, 40, 41, 42:
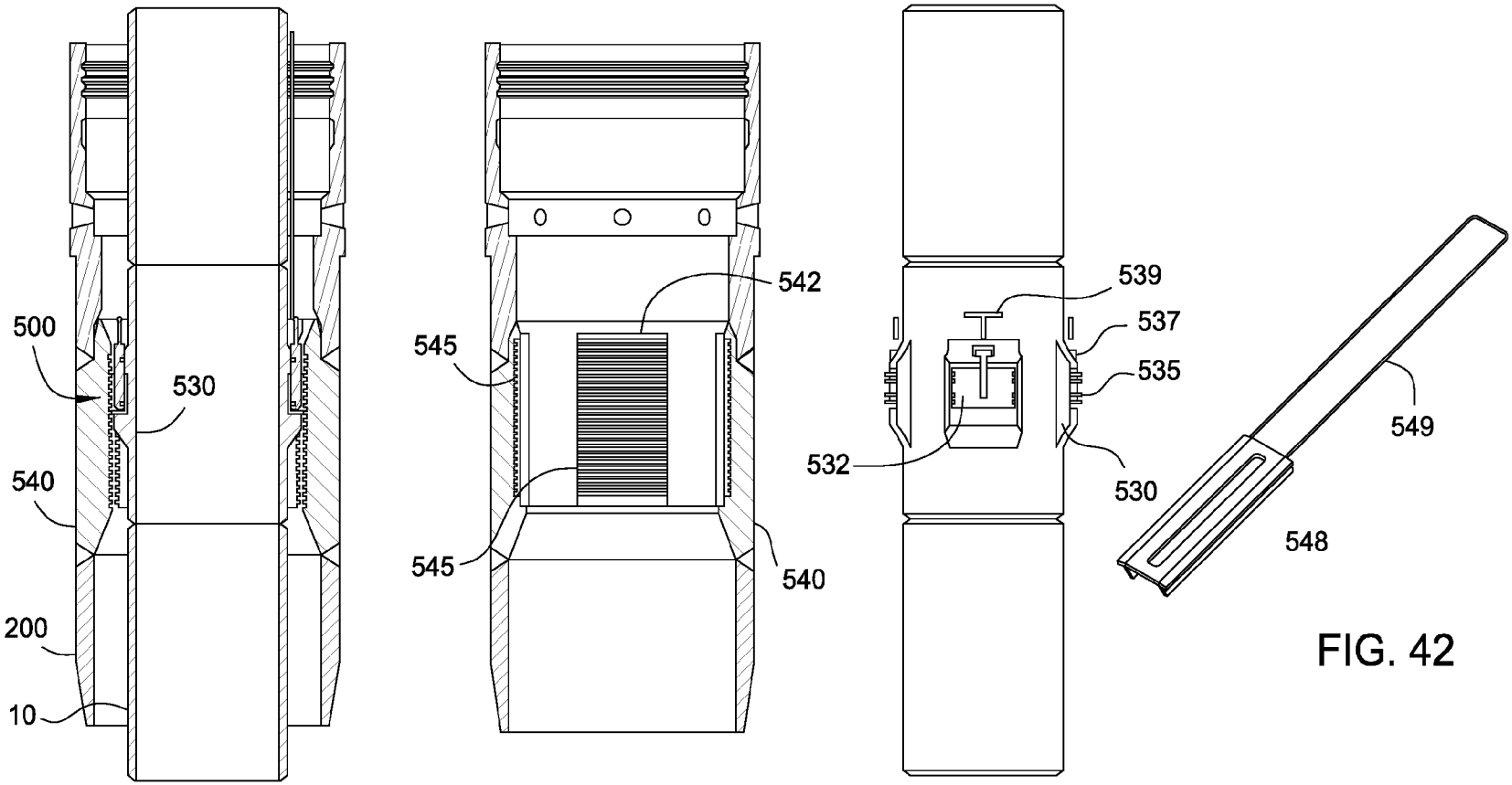
FIGS. 39-49 illustrate another embodiment of a latch mechanism.

As shown in FIG. 34, the housing 440 includes a hydraulics panel 450 for connection with one or more hydraulic lines. A ROV may be used to connect the hydraulic lines to the panel 450. From the panel 450, hydraulic fluid may be directed a particular port(s) to either engage or disengage the load key 445. FIG. 36 shows the activation port 441 for supplying fluid to the portion of the chamber 443 between the piston 446 and the plug 447. Fluid supplied to this portion of the chamber 443 will cause the load key 445 to move radially into engagement with the mandrel 30. As shown, the piston 446 is at the distal end of the chamber 443. FIG. 37 shows the deactivation port 442 for supplying fluid to the portion of the chamber 443 on the other side of the piston 446. Fluid supplied to this portion chamber 443 will cause the load key 445 to move radially to retract from the mandrel 30. As shown, the piston 446 is at the proximal end of the chamber 443. FIG. 38 shows the load key 445 disengaged from key slot the mandrel 30.

Latch Concept 5

Figure 44:
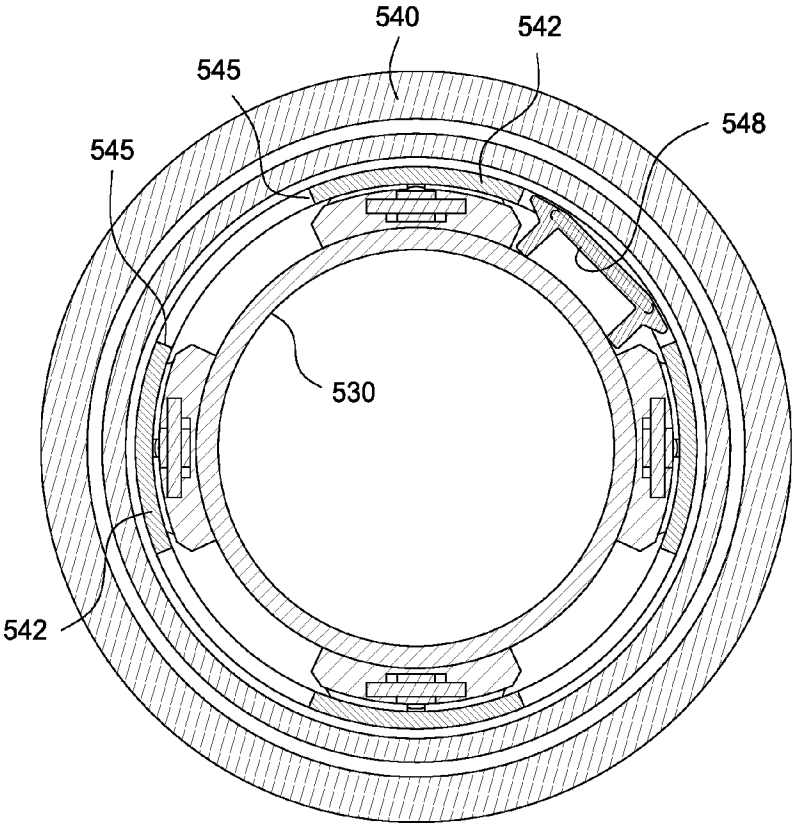
Figure 43:
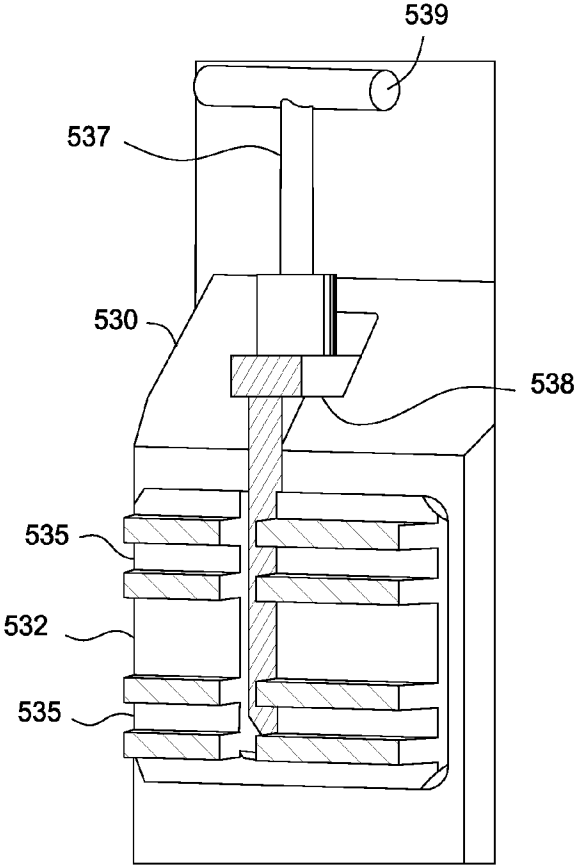

FIGS. 39-42 illustrate the components of another embodiment of a latch mechanism 500 for engaging and disengaging the load keys 545 from the key slots 535. The housing 540 includes a plurality of segments having keys 545 on an interior surface. Referring to FIGS. 43 and 44, the mandrel 530 is provided with a plurality of axial load blocks 532 having slots 535 on an exterior surface. The slots 535 are adapted to engage the keys 545 on the housing 540. The axial load blocks 532 are releasably coupled to the mandrel 530 using a lever 537 coupled to a T-shaped groove 538. The lever 530 may include a handle 539 for the ROV to manipulate. In one embodiment, the mandrel 530 includes four axial load blocks 532 circumferentially spaced on the mandrel 530. Also, the housing 540 includes four segments 542 circumferentially spaced in the housing 540.

Figure 45:
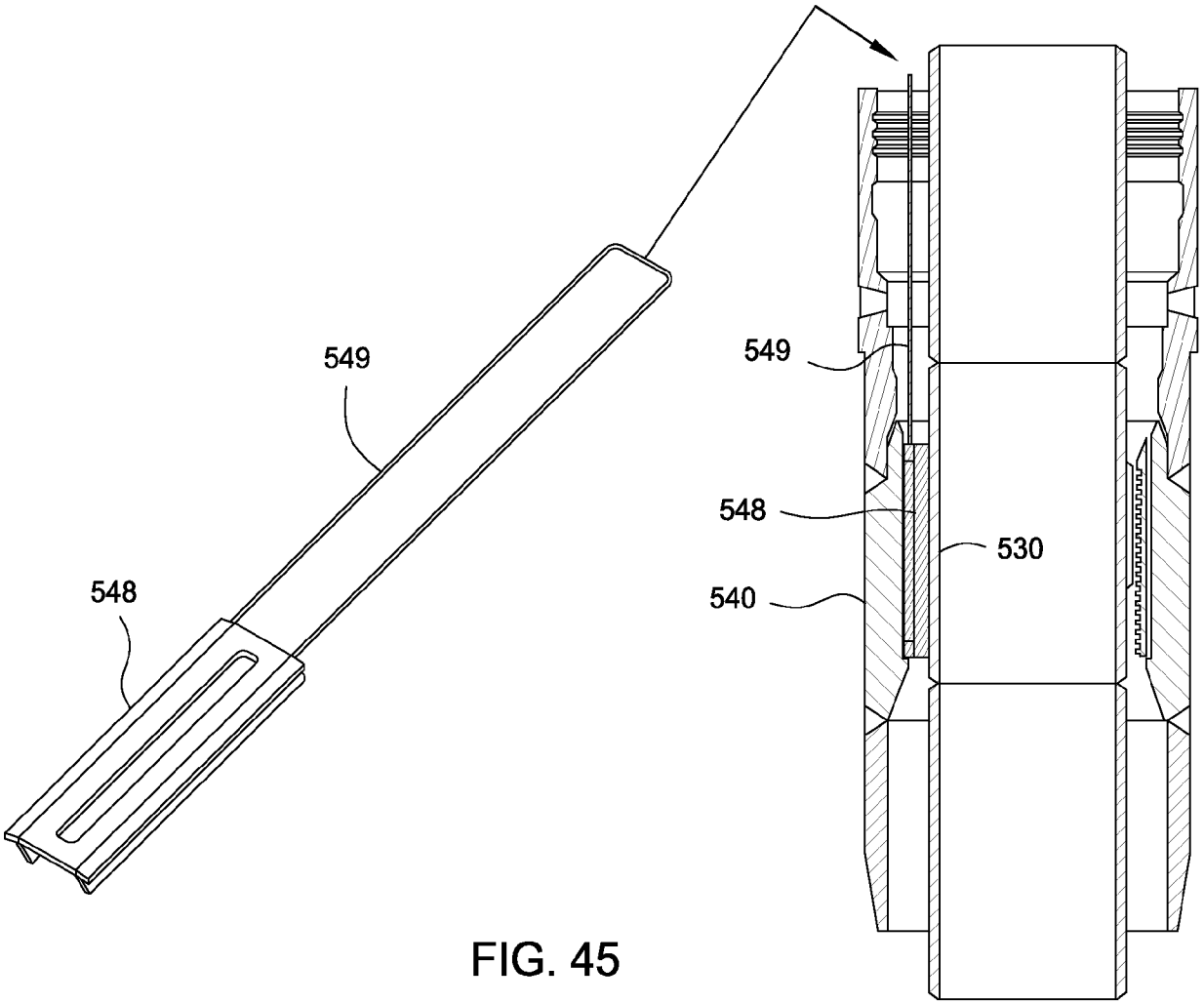

To couple the first casing 10 to the second casing 20, the mandrel 530 is inserted into the housing 540 and the load blocks 532 are positioned between adjacent segments 542. In this respect, the mandrel 530 is free to move axially relative to the housing 540. After the first casing is positioned at the desired location, the mandrel 530 is rotated so that the slots 535 engage the keys 545 on the segments 542. Thereafter, one or more torque keys 548 are inserted in between adjacent segments 542 to prevent the slots 535 from rotating out of engagement with the keys 545. The torque keys 548 may include an extended handle 549 that protrudes out of the top of the second casing, as shown in FIGS. 44 and 45.

Figure 46A:
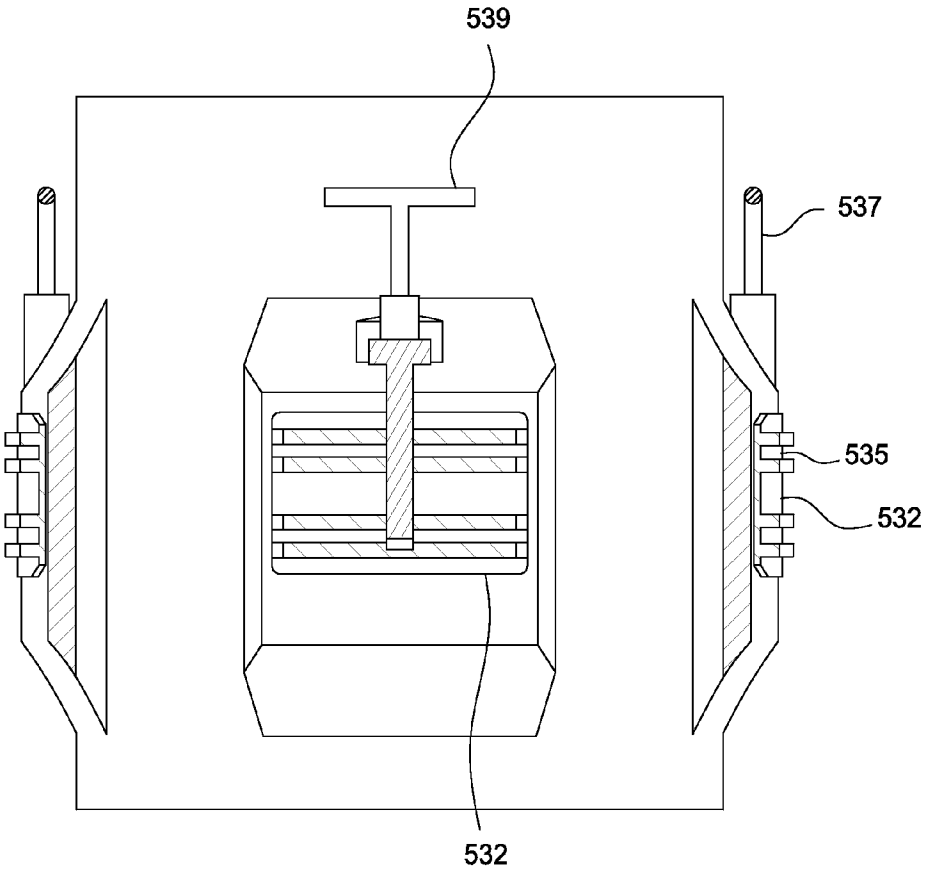
Figure 46:
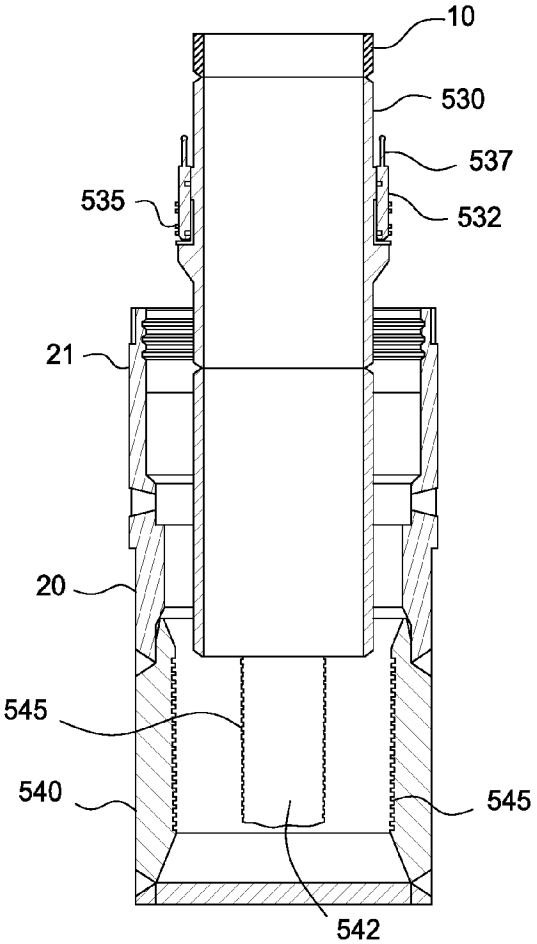
Figure 47B:
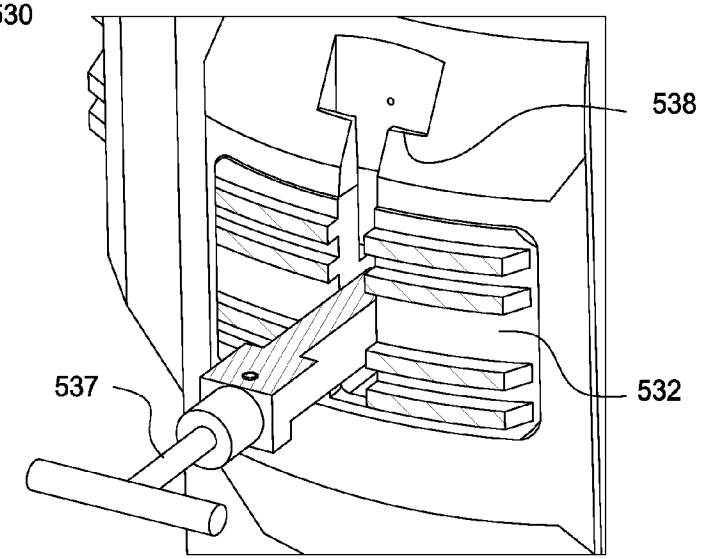
Figure 47A:
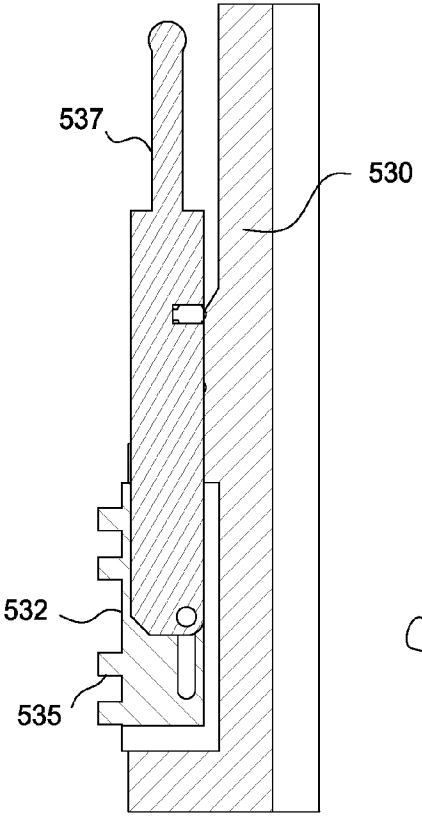
Figure 47:
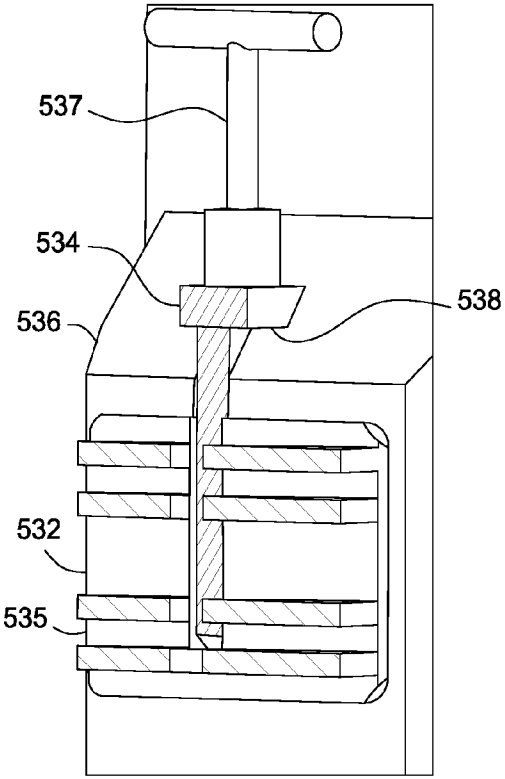
Figure 49:
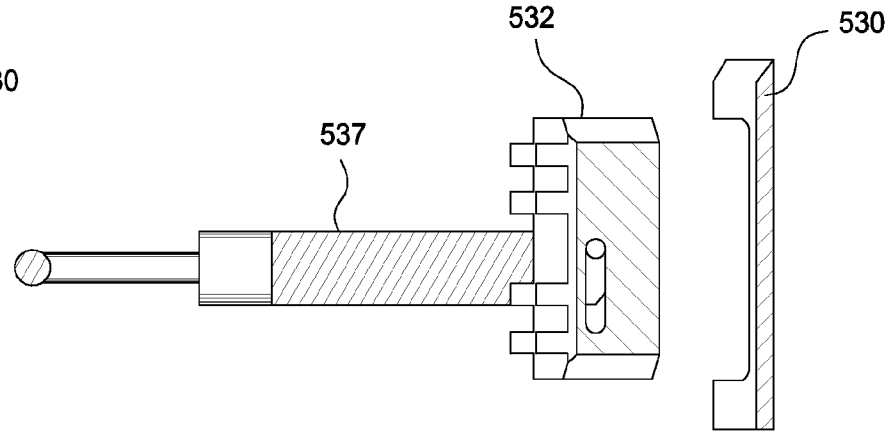
Figure 48:
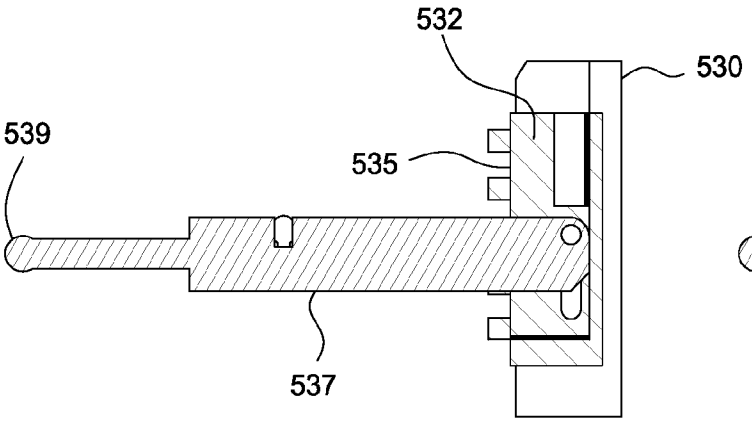

To release the first casing 10, the ROV is operated to pull the torque keys 548 out of the second casing 20. Then the first casing 10 is rotated so that the axial load block 532 is between two adjacent segments 542 of the housing 540, thereby disengaging the slots 535 from the keys 545. As shown, the first casing 10 is rotated one-eighth turn to disengage the slots 535. In this respect, the mandrel 530 is again free to move axially relative to the housing 540. Then, the first casing 10 is lifted until the axial load blocks 532 are above the low pressure wellhead 21, as shown in FIGS. 46 and 46A. FIG. 47 shows a flange 534 of the lever 537 disposed in the T-shaped slot 538 of the mandrel 530. The ROV is operated to grab the handle 539 and pull the flange 534 out of the T-shaped slot 538. FIG. 47A shows the lever 537 lifted up relative to the slots 535. Then, the lever 537 is pivoted relative to the load block 532, as shown in FIGS. 47B and 48. In FIG. 49, the axial load block 532 is removed from the mandrel 530. The mandrel 530 and the first casing 10 are now free to continue drilling.

Latch Concept 6

Figure 50:
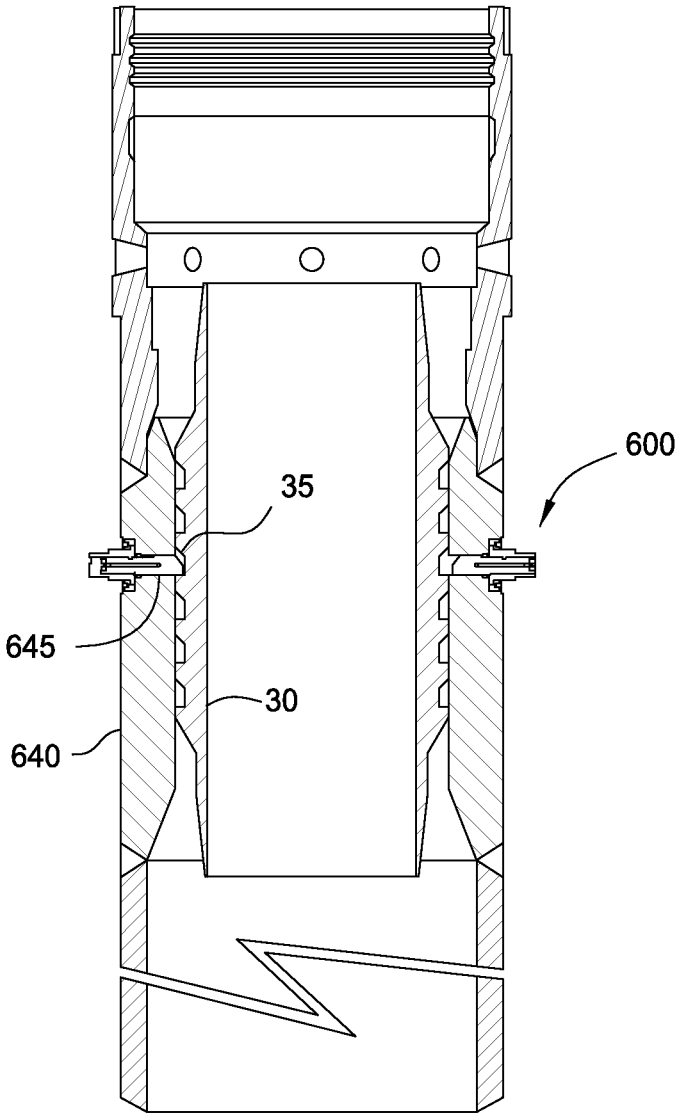
FIGS. 50-54 illustrate another embodiment of a latch mechanism.
Figure 51:
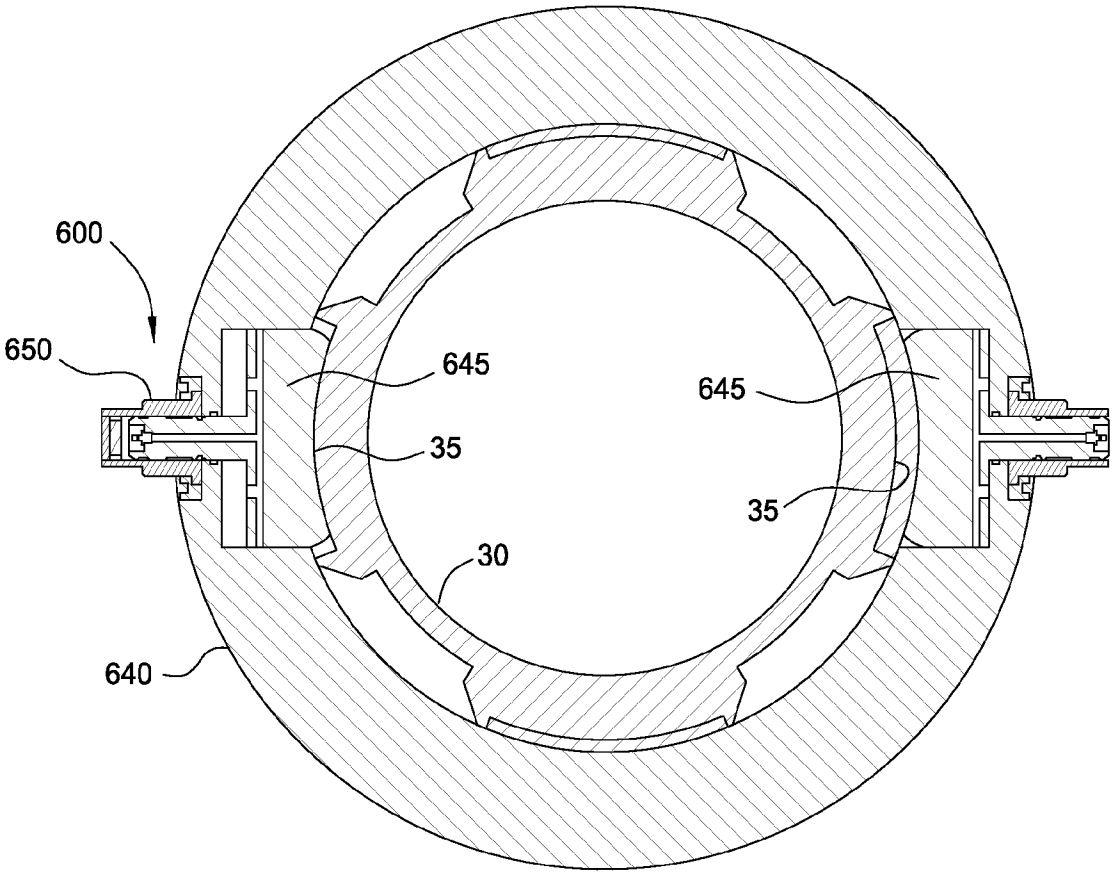

FIGS. 50-54 illustrate another embodiment of a latch mechanism 600 for engaging and disengaging the load keys 645 from the key slots 35. FIGS. 50-51 show the mandrel 30 coupled to the housing 640 via the load keys 645 and the key slots 35. The coupling may be performed at the surface using standard tools. FIG. 51 also shows one of the keys 645 being disengaged from the slot 30.

Referring to FIGS. 51-54, the connector shaft 648 of the key 645 is threadedly coupled to a bore 651 of an adjusting nut 650. Rotation of the nut 650 moves the key 645 radially inward or outward. The threads 656 connecting the shaft 648 to the adjusting nut 650 are shearable when a sufficient amount of force is applied. A key holder 658 is disposed inside the bore 651 of the adjusting nut 650 and is configured to hold the connector shaft 648 of the load key 645 in place. A nut cover 659 is used to couple the adjustment nut 650 to the housing 640 while allowing the nut 650 to rotate relative to the housing 640.

Figure 52:
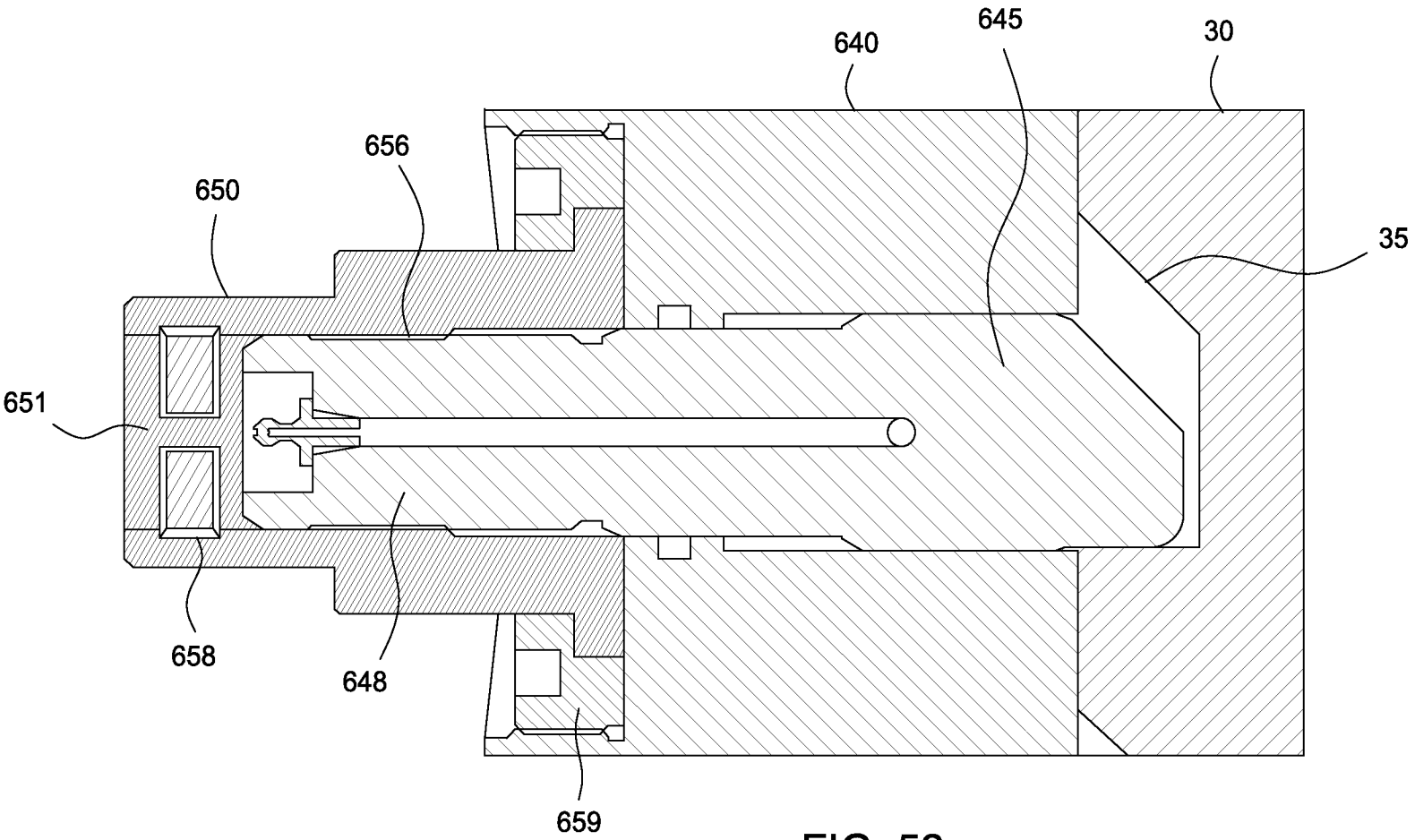
Figure 53:
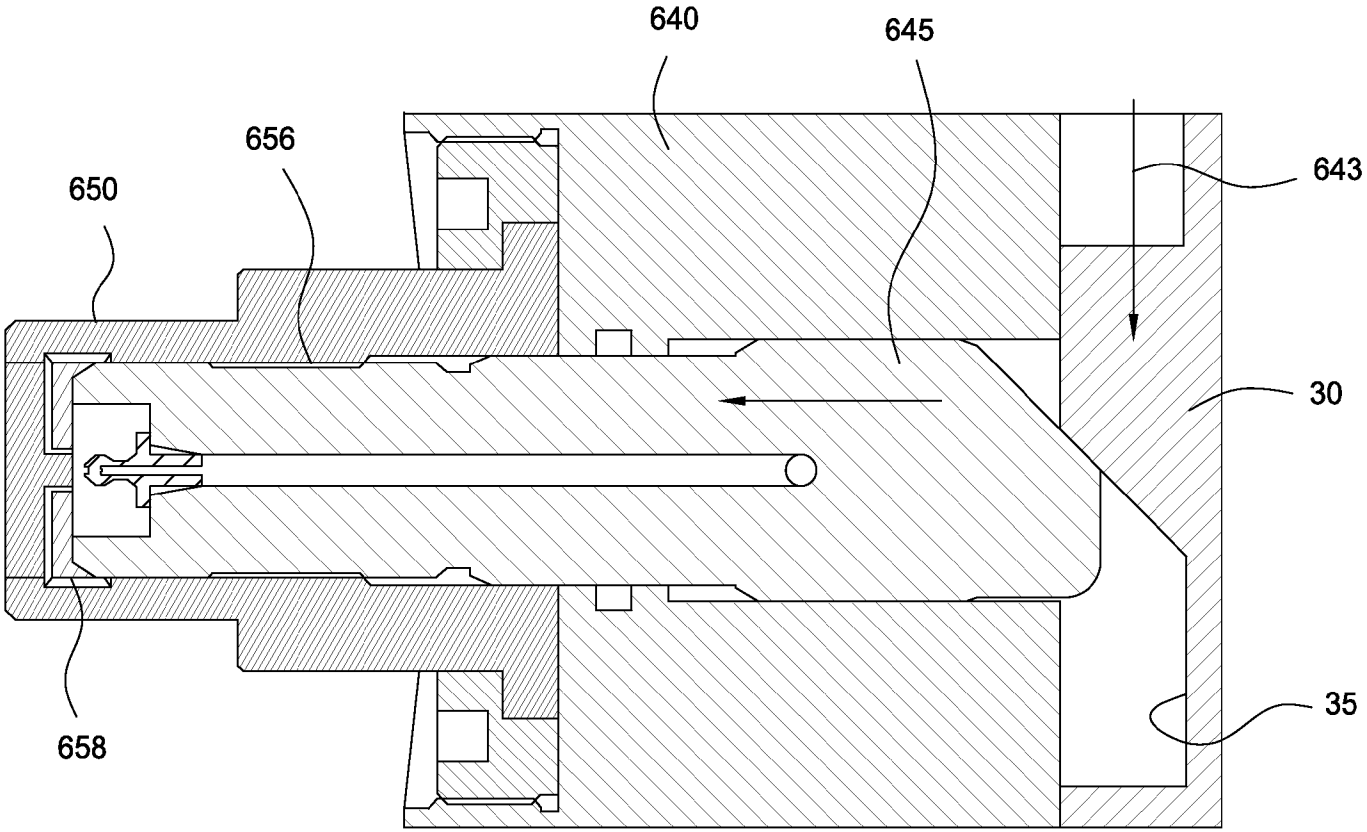
Figure 54:
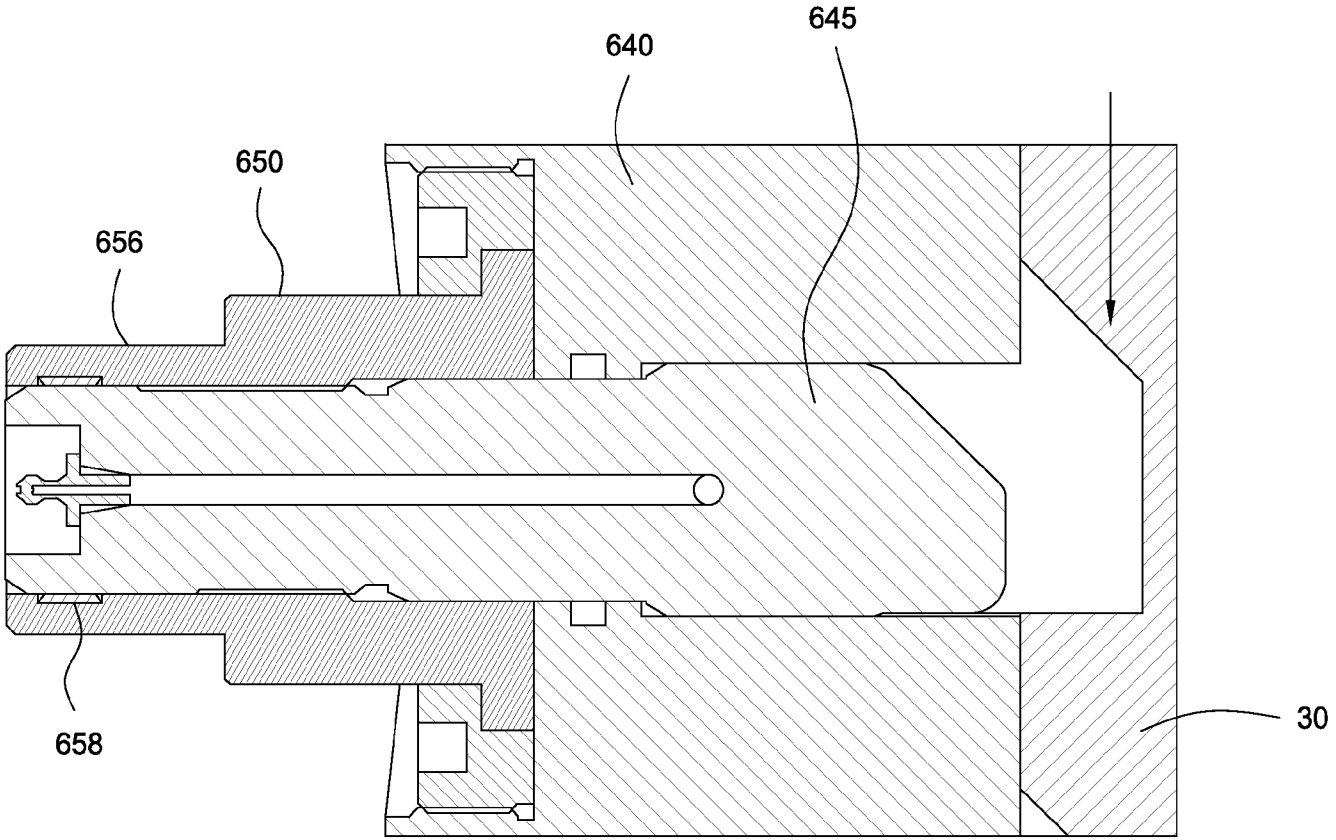

FIG. 52 shows the load key 645 engaged with the slot 35 of the mandrel 30. A torque tool, or other tool suitable for rotating the adjusting nut 650, may be used to rotate the adjusting nut 650 in order to advance the load key 645 toward engagement with the mandrel 30. After coupling the second casing to the first casing, both casings are drilled or jetted until the second casing reaches target depth. Referring to FIG. 53, a downward force 643 is then applied to the second casing, which force is transferred to the load key 645, thereby causing retraction of the load key 645 from the slot 35. The force applied is sufficient to shear the threads 656 to allow the retraction of the load key 645, as shown in FIG. 53. FIG. 54 shows the load key 645 fully retracted and the threads sheared. The load key 645 is held in this position by the key holder 658. The first casing 10 is now free to continue drilling down.

Latch Concept 7

Figure 55C:
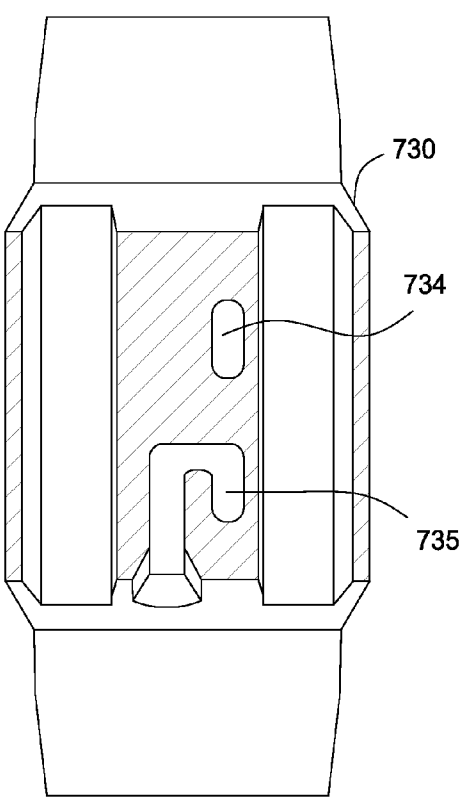
FIGS. 55A-57 illustrate another embodiment of a latch mechanism.
Figure 55B:
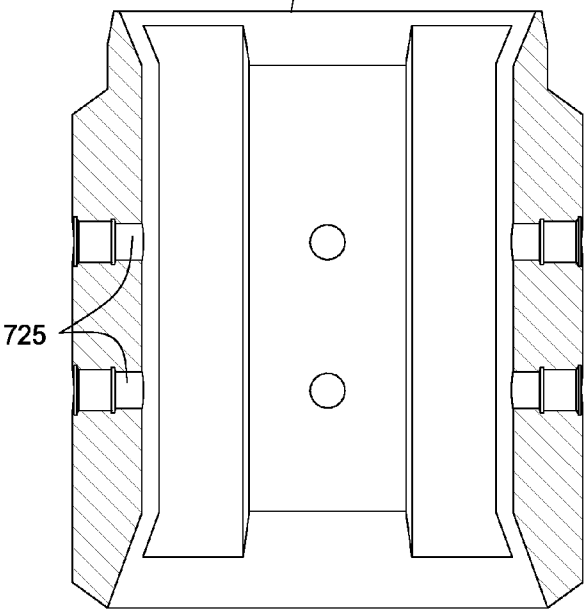
Figure 55A:
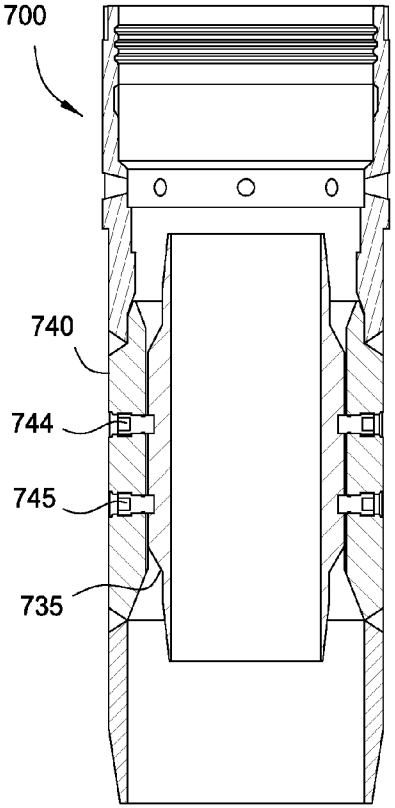
Figure 56:
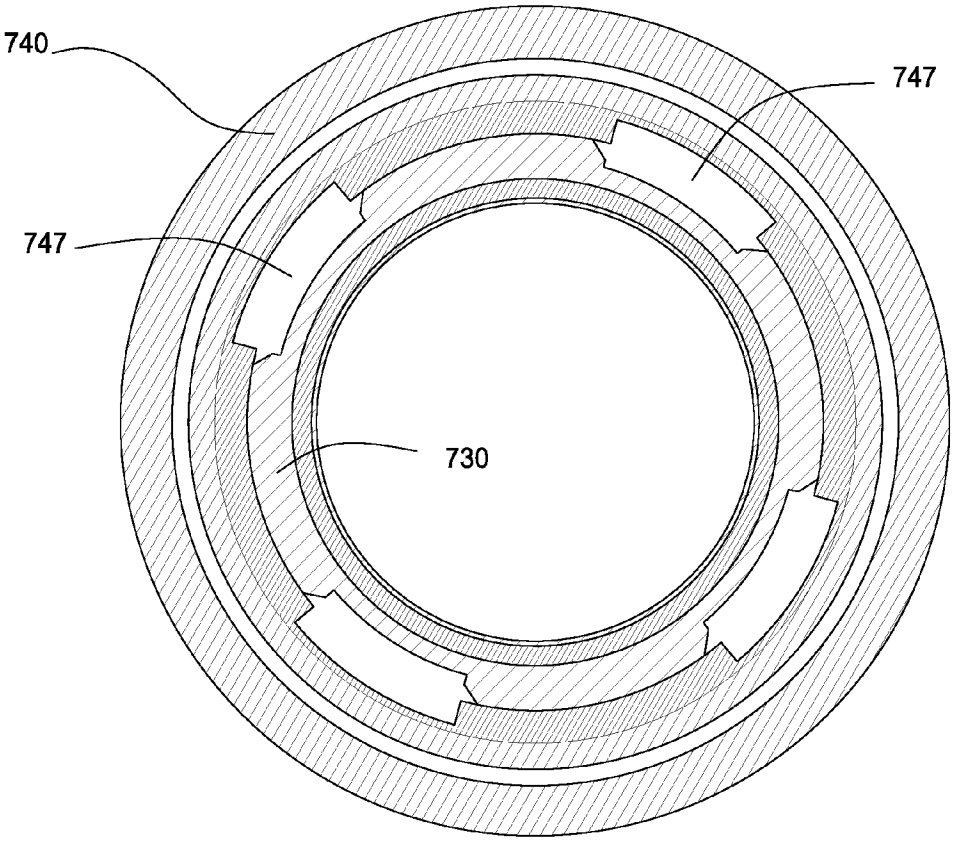
Figure 57:
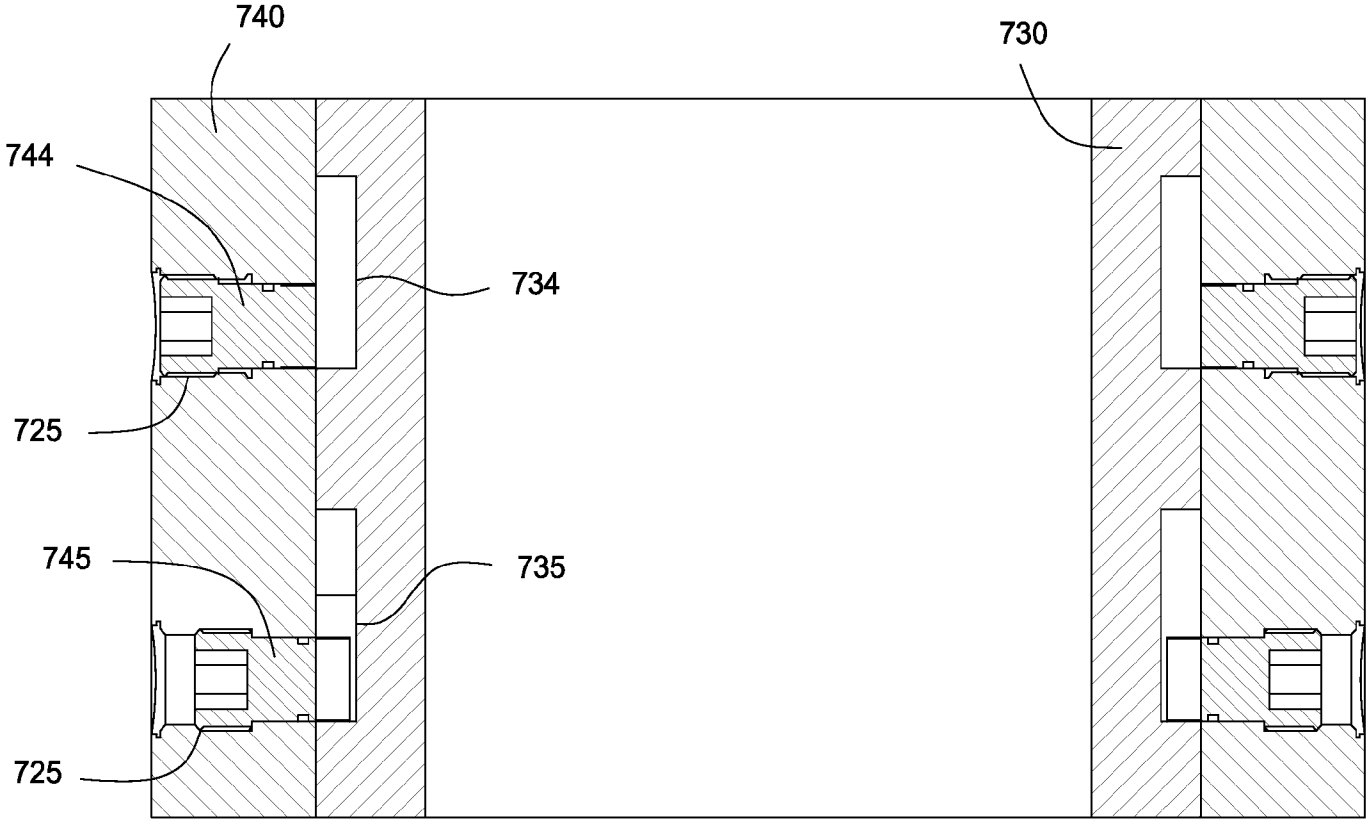

FIGS. 55-57 illustrate another embodiment of a latch mechanism 700 for coupling the mandrel 730 of the first casing to the housing 740 of the second casing. As shown in FIGS. 55A-C, the housing 740 includes four sets of dual aperture arrangement circumferentially spaced around the housing 740. Each of the apertures 725 is adapted to threadedly receive a pin 744, 745. The outer surface of the mandrel 730 may include four sets of grooves. Each set of grooves include a longitudinal groove 734 and an arcuate groove 735. In one embodiment, the arcuate groove may be a j-slot groove. The lower end of the j-slot groove 735 is configured to slidably engage a pin 745 protruding from the aperture 725. A recess 747 may be provided between adjacent sets of grooves and adjacent sets of aperture arrangements, as shown in FIG. 56. The recess 747 may allow fluid flow past the mandrel 730.

To couple the mandrel 730 to the housing 740, a pin 745 is inserted into the lower aperture 725 and rotated to protrude out of the housing 740. The lower end of the j-slot groove 735 is aligned with the pin 745 so that lowering the mandrel 730 into the housing 740 allows the pin 745 to slide along the j-slot groove 735. The mandrel 730 is then rotated to track the pin 745 along the j-slot groove 735, and thereafter the mandrel 730 is pulled up to place the pin 745 at the end of the j-slot groove 735. Then, a second pin 744 is rotated to protrude out of the second aperture 725 and engage the longitudinal groove 734. The second pin 744 prevents inadvertently release of the mandrel 730 from the housing 740. FIG. 57 shows the two pins 744, 745 engaged with their respective grooves 734, 735.

To release the mandrel 730, all pins 744 and 745 are rotated out of engagement with the longitudinal groove 734. An ROV may be used to rotate the pins 744 and 745.

While the foregoing is directed to embodiments of the present invention, other and further embodiments of the invention may be devised without departing from the basic scope thereof, and the scope thereof is determined by the claims that follow.

The invention claimed is:

1. A latch assembly for coupling a first tubular to a second tubular, comprising:

a mandrel having a plurality of key slots and connected to the first tubular;

a housing for receiving the mandrel and connected to the second tubular;

a plurality of keys radially movable into engagement or out of engagement with a respective key slot;

a collet configured to engage the housing and a respective key; and a retainer ring configured to hold the plurality of keys in engagement with the respective key slot, wherein the keys include a connector shaft coupled to the retainer ring.

2. The latch assembly of claim 1, further comprising a retaining pin for coupling at least two segments of the retainer ring.

3. The latch assembly of claim 2, further comprising a nut threadedly coupled to the retainer ring.

4. The latch assembly of claim 3, further comprising a holding bolt coupled to a respective one of the plurality of keys.

5. The latch assembly of claim 2, wherein the retaining pin is movable by a hydraulic piston coupled to the retaining pin via an adapter block.

6. The latch assembly of claim 2, wherein the retaining pin is movable by a hydraulic piston coupled to the retaining pin via a cable.

7. The latch assembly of claim 2, wherein the retaining pin is configured to be rotated into and out of engagement with the retainer ring.

8. The latch assembly of claim 2, wherein the retaining pin is configured to couple the retainer ring to the housing.

9. The latch assembly of claim 8, wherein the retainer ring is disposed around the housing.

10. The latch assembly of claim 1, wherein the plurality of keys include a fluid channel.

11. The latch assembly of claim 1, further comprising a nut threadedly coupled to the retainer ring.

12. The latch assembly of claim 1, wherein the collet is a dual collet.

13. The latch assembly of claim 12, wherein the collet comprises an annular ring having an interior collet finger for engaging the respective key and an exterior collet finger for engaging the housing.

14. The latch assembly of claim 1, wherein the retainer ring is disposed around the housing.

15. A method of coupling a first tubular to a second tubular, comprising:

coupling a mandrel to the first tubular, the mandrel having a plurality of key slots;

coupling a housing to the second tubular, the housing having a plurality of keys;

disposing the mandrel in the housing;

aligning the plurality of keys to a respective key slot;

radially moving the plurality of keys into engagement with the respective key slot;

engaging a collet with the housing;

retaining the plurality of keys in engagement with the respective key slot using a retainer ring; and releasing the retainer ring from the housing, thereby allowing the plurality of keys to disengage from the respective key slot.

16. The method of claim 15, wherein radially moving the plurality of keys comprises rotating a nut coupled to the retainer ring.

17. The method of claim 15, wherein retaining the plurality of keys comprises coupling a retaining pin to at least two segments of the retainer ring.

18. The method of claim 17, wherein the retaining pin simultaneously engages the retainer ring and the housing.

19. The method of claim 17, wherein coupling the retaining pin comprises rotating the retaining pin into engagement with the retainer ring.

20. The method of claim 15, further comprising:

deploying the first tubular and second tubular downhole; and releasing the first tubular from the second tubular.

21. The method of claim 20, wherein releasing the first tubular from the second tubular comprises opening the retainer ring.

22. A latch assembly for coupling a first tubular to a second tubular, comprising:

a mandrel having a plurality of key slots and connected to the first tubular;

a housing for receiving the mandrel and connected to the second tubular;

a plurality of keys radially movable into engagement or out of engagement with a respective key slot;

a collet configured to engage the housing and a respective key; and a retainer ring configured to hold the plurality of keys in engagement with the respective key slot and configured to release from the housing to allow the plurality of keys to disengage from the respective key slot.

23. The latch assembly of claim 22, further comprising a retaining pin for coupling at least two segments of the retainer ring.

24. The latch assembly of claim 22, wherein the plurality of keys include a fluid channel.

25. The latch assembly of claim 22, further comprising a nut threadedly coupled to the retainer ring.

26. The latch assembly of claim 22, wherein the retainer ring is disposed around the housing.

27. The latch assembly of claim 22, wherein the collet comprises an annular ring having an interior collet finger for engaging the respective key and an exterior collet finger for engaging the housing.

* * * * *